United States Patent [19]

Nishikawa et al.

[11] Patent Number: 4,639,699

[45] Date of Patent: Jan. 27, 1987

[54] DIELECTRIC RESONATOR COMPRISING A RESONANT DIELECTRIC PILLAR MOUNTED IN A CONDUCTIVELY COATED DIELECTRIC CASE

[75] Inventors: Toshio Nishikawa, Nagaokakyo; Youhei Ishikawa, Kyoto; Hidekazu Wada, Kobe, all of Japan

[73] Assignee: Murata Manufacturing Co., Ltd., Japan

[21] Appl. No.: 537,711

[22] Filed: Sep. 30, 1983

[30] Foreign Application Priority Data

| | | | |
|---|---|---|---|
| Oct. 1, 1982 | [JP] | Japan | 57-173713 |
| Oct. 4, 1982 | [JP] | Japan | 57-175458 |
| Oct. 4, 1982 | [JP] | Japan | 57-151615[U] |
| Oct. 5, 1982 | [JP] | Japan | 57-151578[U] |
| Oct. 7, 1982 | [JP] | Japan | 57-176707 |
| Oct. 7, 1982 | [JP] | Japan | 57-152415[U] |
| Oct. 18, 1982 | [JP] | Japan | 57-183170 |
| Nov. 12, 1982 | [JP] | Japan | 57-171900[U] |
| Dec. 6, 1982 | [JP] | Japan | 57-185090[U] |
| Feb. 1, 1983 | [JP] | Japan | 58-14075[U] |
| Feb. 1, 1983 | [JP] | Japan | 58-14076[U] |

[51] Int. Cl.[4] ..... H01P 7/10

[52] U.S. Cl. ..... 333/202; 333/219; 333/234; 333/235

[58] Field of Search ..... 333/219, 234, 235, 229, 333/202

[56] References Cited

U.S. PATENT DOCUMENTS

| | | | |
|---|---|---|---|
| 2,281,247 | 4/1952 | Peterson | 333/234 |
| 3,713,051 | 1/1973 | Kell | 333/202 X |
| 3,955,161 | 5/1976 | MacTurk | 333/248 |
| 4,477,785 | 10/1984 | Atia | 333/219 X |

FOREIGN PATENT DOCUMENTS

| | | | |
|---|---|---|---|
| 2109641 | 6/1983 | United Kingdom | 333/202 |

*Primary Examiner*—Eugene R. LaRoche
*Assistant Examiner*—Benny T. Lee
*Attorney, Agent, or Firm*—Ostrolenk, Faber, Gerb & Soffen

[57] ABSTRACT

A dielectric resonator is disclosed which includes a case having a resonator main body portion, an upper lid and a lower lid. Inside the case is a cylindrical dielectric material. The case is formed of a dielectric material having the same coefficient of linear expansion as the cylindrical dielectric material. In one embodiment, main body portion comprises a dielectric case side portion with the cylindrical dielectric material disposed concentrically in a concavity defined by the case side portion, with the cylindrical dielectric material being integrally coupled to the dielectric case side portion by four connecting portions. More specifically, in this embodiment, the case side portion of the main body portion and the cylindrical portion are simultaneously and integrally formed of the same dielectric material. A conductive film is formed to enclose a region surrounding the cylindrical dielectric material. In one embodiment, the conductive film is formed on the whole outer surface of the dielectric case side portion and conductive films and are also formed on the lower surface of the upper lid and the upper surface of the lower lid.

39 Claims, 50 Drawing Figures

DIELECTRIC RESONATOR COMPRISING A RESONANT DIELECTRIC PILLAR MOUNTED IN A CONDUCTIVELY COATED DIELECTRIC CASE

BACKGROUND OF THE INVENTION

1. Field of the Invention

The present invention relates to a dielectric resonator. More specifically, the present invention relates to an improvement in the temperature characteristic of the resonance frequency in a dielectric resonator utilizing the $TM_{010}$ mode or a modified mode thereof of an electromagnetic wave.

2. Description of the Prior Art

FIGS. 1 and 2 are views showing one example of a conventional dielectric resonator using the $TM_{010}$ mode which constitutes the background of the present invention. More specifically, FIG. 1 is a longitudinal sectional view of the resonator and FIG. 2 shows a transverse sectional view of the resonator taken along the line II—II in FIG. 1. Referring to FIGS. 1 and 2, a dielectric resonator 1 comprises a case 2 formed wholly of metal, and a cylindrical dielectric member 4 of the length L disposed in a concavity 3, circular in section, defined in the case 2. An electromagnetic field distribution of the $TM_{010}$ mode is shown therein, in which the solid line arrow 5 shows an electric line of force and a dotted line arrow 6 shows a magnetic line of force.

As shown in FIGS. 1 and 2, the $TM_{010}$ mode is a mode in which the electric field is mostly concentrated inside the dielectric cylinder 4 and hence this mode enables miniaturization of the resonator 1. In such a case, the resonator 1 is effective for the $TM_{010}$ mode and is less effective for the other modes. In this mode the resonance frequency $f_0=C/\lambda_0$, (where C is a light velocity and $\lambda_0$ is the resonance wave length) has no relation to the length of the resonator (the length of the cylindrical dielectric member) L. Accordingly, a dielectric resonator can be implemented in a smaller size.

Thus, a dielectric resonator using the $TM_{010}$ mode or a modified mode thereof includes various advantages and hence can be advantageously utiized as a filter or an oscillating element.

However, a conventional $TM_{010}$ mode dielectric resonator has the disadvantage that the temperature characteristic of a resonance frequency is not good. More specifically, assuming that the temperature characteristic of the resonance frequency is $\eta_f$, then the following formula is obtained:

$$\eta_f=-C\eta_\epsilon-A\alpha_1-B\alpha_2 \quad (1)$$

where

- $\eta_\epsilon$: the temperature characteristic of the dielectric constant
- $\alpha_1$: the coefficient of linear expansion of the dielectric material
- $\alpha_2$: the coefficient of linear expansion of a metallic case
- A, B, C: constants In other words, the temperature characteristic $\eta_f$ of the resonance frequency is related to the respective coefficients of linear expansion $\alpha_1$ and $\alpha_2$ of the dielectric material and the metallic case as well as the temperature characteristic $\eta_\epsilon$ of the dielectric constant. In order to make better the temperature characteristic $\eta_f$ of the resonance frequency, it is necessary to properly control the coefficients of linear expansion $\alpha_1$ and $\alpha_2$ of dielectric material and the metallic case as well as to select the temperature characteristic $\eta_\epsilon$ of the dielectric constant determined by the dielectric material. However, it is difficult to properly control simultaneously the coefficients of linear expansion $\alpha_1$ and $\alpha_2$ of the dielectric material and the metallic case in the light of the properties thereof. As a result, the temperature characteristic $\eta_f$ of the resonance frequency is poor.

Viewed from another angle, this means that a conventional resonator including a cylindrical dielectric material 4 disposed in a metallic case 2 exhibits a change in the small gap in the coupling region between the end surface 4a of the cylindrical dielectric material 4 and the facing surface 7 of the metallic case as a result of a change of the temperature around the resonator 1. This change results from a difference between the respective coefficients of linear expansion of the dielectric material 4 and the metallic case 2. The above described change in the gap occurring in the above described coupling region gives rise to a change in currents that flow in the devce, resulting in a change in the effective dielectric constant. This results in a change in the capacitance C which is one of the factors determining the resonance frequency $f_0$ ($f_0=\frac{1}{2}\pi\sqrt{LC}$). Accordingly, the conventional resonator has the disadvantage that a change in the resonance frequency occurs due to the temperature because difference between the coefficients of linear expansion of the case 2 and the dielectric material 4.

One example of an approach for eliminating the above described shortcomings is described in Japanese Laid Open Patent No. 119650/1978, laid open Mar. 29, 1977 and entitled "Very Small Sized Bandpass Filter Using $E_{010}$ Mode of Dielectric Resonator". The above referenced Japanese Laid Open Patent is directed to a bandpass filter having an improved temperature characteristic using a resonator of the $E_{010}$ (=$TM_{010}$) mode, in view of the fact that a bandpass filter using $H_{08}$ mode has a worse spurious characteristic. More specifically, the resonator disclosed in the above referenced Japanese Laid Open Patent is adapted such that an aperture is formed on each end surface of a concavity in a metallic cylinder and both ends of the dielectric cylinder are extended into the end surfaces of the cylindrical concavity. As a result little influence is exerted upon the resonance frequency by expansion and contraction of the ends of the dielectric cylinder due to a change in the temperature.

Another conventional approach for improving the temperature characteristic of a dielectric resonator will be described in the following.

FIG. 3 is a longitudinal sectional view of another example of a conventional dielectric resonator.

Referring to FIG. 3, a dielectric resonator 10 comprises a conductive case 2 formed wholly of metal and defining a cylindrical concavity 3, and a cylindrical dielectric material 4 disposed concentrically at the center of the cylindrical concavity 3. Although the conductive case 2 is rigidly formed as a whole so as not to be readily deformed, only a bottom plate 2a of the case 2 is made to be as thin as 0.6 to 0.8 mm so as to be bent when the same is pressed with a finger.

An auxiliary case 11 is coupled to the bottom of the conductive case 2 by means of a coupling member 12, for example. A pressing member 13 and a dished spring 14 are disposed in the auxiliary case 11. The pressing member 13 is pressed toward the bottom plate 2a of the conductive case 2 by means of the dished spring 14. As a result, the bottom plate 2a is normally pressed upward by the pressing member 13, i.e. toward the bottom end of the cylindrical dielectric material 4 so as to be in contact with the lower end surface of the dielectric material 4. This contact is not changed by a change in the ambient temperature.

More specifically, if and when the ambient temperature of the resonator 10 changes, expansion and contraction of the conductive case 2 are larger than those of the dielectric material 4 due to a difference between the coefficients of linear expansion of the conductive case 2 and the cylindrical dielectric material 4 (generally the coefficient of linear expansion $\alpha_1$ of a conductor is larger than the coefficient of linear expansion $\alpha_2$ of a dielectric material), so that an increase in the temperature causes the bottom plate 2a of the conductive case to expand in the direction away from the bottom end surface of the cylindrical dielectric material 4, as shown by the solid line in FIG. 4, which shows a partial view of a portion encircled with the line IV in FIG. 3. However, since the bottom plate 2a is pressed toward the lower end surface of the dielectric material 4 by means of the pressing member 13 and the bottom plate 2a has elasticity, at least a portion of the bottom plate 2a pressed by the pressing member 13 is kept in close contact with the lower end surface of the cylindrical dielectric material 4.

Meanwhile, although the dielectric resonator 10 shown in FIGS. 3 and 4 was adapted to have an increased area of the portion where the bottom plate 2a is pressed by the pressing member 13, it is needless to say that the pressing member 13 is not necessarily an indispensable member and alternatively the resonator may be adapted such that the bottom plate 2a is directly pressed by the dished spring 14.

Preferably a contacting portion 13a of the pressing member 13 contacting the bottom plate 2a is selected to be at least of the same size or larger than the end surface of the cylindrical dielectric material 4, because this ensures that the bottom plate 2a is in close contact with the whole end surface of the dielectric material 4.

Since the dielectric resonator 10 shown in FIGS. 3 and 4 employed a dished spring 14 for the purpose of pressing the bottom plate 2a toward the end surface of the cylindrical dielectric material 4, the resonator is advantageous because a dished spring is compact, thin and stable. This permits the auxiliary case 11 to be accordingly compact. Alternatively, the bottom plate 2a may be pressed by a leaf spring, for example.

An aperture 15 is formed at the center of the dished spring 14 so that a protruding portion 13b of the pressing member 13 may be fitted thereinto. Such structure facilitates positioning of the pressing member 13.

Although the auxiliary case 11 was mounted to the conductive case 2 by means of the coupling member 12, alternatively the auxiliary case 11 may be shaped to enclose the whole of the conductive case 2.

Now referring to FIGS. 5 to 7, another example of a conventional resonator constituting the background of the present invention will be described in the following.

FIG. 5 is a longitudinal sectional view of this example of a conventional dielectric resonator, FIGS. 6A and 6B are partial views of a portion encircled with the line VI in FIG. 5, and FIG. 7 is a plan view of the resonator shown in FIG. 5. Referring to FIGS. 5 to 7, a dielectric resonator 20 comprises a conductive case 2 and a cylindrical dielectric material 4, as is the same as shown in FIGS. 3 and 4. The dielectric resonator 20 shown in FIG. 5 is characterized in that a groove 21 is formed on the outer surface of an upper plate 2b of the conductive case 2 contacting the upper end surface of the cylindrical dielectric material 4. The groove 21 is at a position corresponding to the periphery of the end surface of the dielectric material 4. Another groove 22 is also formed in the vicinity of the lower end portion of the side plate 2c of the conductive case 2. The groove 21 formed on the upper plate 2b may be of a circle of the same diameter as that of the section of the dielectric material 4 but may also be larger than that. The sectional shape of the grooves 21 and 22 need not be necessarily of a letter V in section and may of an arbitrary shape such as of a rectangle in section across its depth.

Since the above described grooves 21 and 22 are formed on the conductive case 2 in the above described manner, the conductive case 2 can be elastically bent only at these grooves 21 and 22.

Now assume that a force is applied in the direction of the arrow 23 shown in FIG. 5, i.e. in the direction of bringing the conductive case 2 in close contact with the end surface of the dielectric material 4. The upper plate 2b of the conductive case 2 is bent outward at the groove 21, as shown in FIG. 6A, when the ambient temperature surrounding the resonator 20 is low, because of a difference between the coefficients of linear expansion of the dielectric material and the metal. Conversely, if and when the ambient temperature is high, the metal expands more and the upper plate 2b is bent inward at the groove 21, as shown in FIG. 6B. In either event, i.e. irrespective of a change in the ambient temperature, the central portion surrounded by the groove 21 of the upper plate 2b is kept in contact with the end surface of the dielectric material 4, so that no gap is caused between the end surface of the dielectric material 4 and the conductive case 2. Meanwhile, it is to be pointed out that in FIGS. 6A and 6B deformation of the upper plate 2b has been shown in an exaggerated manner for purpose of illustration.

The groove 22 (FIG. 5) formed on the side plate 2c allow the side plate 2c to be bent inwardly about the groove 22 in accordance with the bending of the upper plate 2b. As a result, any distortion of the case 2 due to the bending of the upper plate 2b is absorbed by the side plate 2c, whereby no force is exerted upon the bottom plate 2a. In other words, the bottom plate 2a is normally kept flat as a whole. As a result, in applying such resonator 20 as a filter, for example, such a connector 24 as shown by the dotted line can be stably fixed to the bottom plate 2a.

A groove may be formed at the position of bottom plate 2a symmetrical to that of the upper plate 2b in place of the groove 22 formed on the side plate 2c.

Referring to the example described in the foregoing, the force in the direction of the arrow 23 (FIG. 5) to be applied to the conductive case 2 may be applied externally by means of a spring force. Alternately, by selecting the height of the cylindrical dielectric material 4 to be slightly larger than the height of the metallic case 2, a force can be applied normally in the direction of the arrow 23 as a function of the elasticity of the case 2 itself.

As a result of the above described structure, the temperature coefficient $\eta_{of}$f the resonance frequency of the resonator has been measured for the conventional example (FIGS. 1 and 2) in which the conductive case is not changed and for the resonator of the other conventional examples shown in FIGS. 3 to 7. The results revealed that the temperature coefficient of the resonant frequency was greatly improved from 150 ppm/°C. for the conventional resonators to approximately 10 to 20 ppm/°C. for the last described example.

Although the above described dielectric resonators shown in FIGS. 4 to 7 employ countermeasures against a change in the resonance frequency due to thermal expansion, they still involve a problem of preventing a flow of a real current through the conductive case.

FIG. 8 is a view showing a flow of a real current through a conductive case of a dielectric resonator and FIG. 9 is a perspective view of a conductive case. As seen from FIG. 8, a real current flowing from the end surface of the dielectric material 4 into the conductive case 2 diverges from the center of the end surface of the case radially toward the peripheral surface of the case and the current flows on the peripheral surface of the case in parallel with the center axis of the dielectric cylinder 4 into the central portion of the other end surface of the case 2.

However, as shown in FIG. 9, the conventional conductive case 2 comprises a case upper lid 201, a case side portion 202 and a case lower lid 203 in combination. Therefore, interfaces 204 and 205 are formed, as shown in FIG. 1, in the conductive case 2 at a contact portion between the upper lid 201 and the side portion 202 and a contact portion between the lower lid 203 and the side portion 202. These interfaces 204 and 205 are formed in the direction perpendicular to the direction of a flow of a real current. However, by forming an interface in the conductor in the direction perpendicular to the direction of the flow of the real current i.e. in the direction intersecting the direction of a flow of the current, the resistance at that portion is increased, resulting in a loss of power P, represented as $P=I^2R$. As a result, a joule heat is generated at the interface contact portion and the no-load quality factor Q is decreased. An approach for solving this problem is set forth in the following.

FIG. 10 is a perspective view of a conductor case, in which the conductor case 25 is shown as disassembled. As shown in FIG. 10, the conductor case 25 comprises symmetrical case portions 25*a* and 25*b* separable in the plane including the center axis 401 of a cylindrical dielectric member 4 disposed in the center of the case 25. The case portions 25*a* and 25*b* as combined are fixed with fixing screws. As a result, a joining surface 26 of the case 25 is formed in parallel with the center axis 401 of the dielectric material 4. In other words, the joining surface 26 is formed in parallel with the direction of a flow of a real current (FIG. 8) flowing in the above described case which is not the direction intersecting the direction of a flow of a real current. As a result, no contact resistance is interposed on the joining surface 26 against a flow of a real current and accordingly little current loss is caused and the no-load quality factor is not decreased.

FIGS. 11A and 11B are views showing other manners of dividing the conductive case. As shown in FIG. 11A, insofar as the case 25 is divided into a plane or planes including the center axis of the dielectric material, the case 25 may be not only a combination of two separated portions but also a combination of four separated portions. As shown in FIG. 11B, the case 25 may be a combination of three separated case portions or may be any other combination of otherwise separated case portions.

Meanwhile, since the above described dielectric resonators shown in FIGS. 1 to 11B employ a metallic conductive case, the same unavoidably become expensive. The reason is that the necessity of improving the temperature characteristic of the resonance frequency in the light of a difference between the coefficients of linear expansion of the metal and dielectric material complicates the structure of the conductive case, as shown in FIGS. 3 to 7. It also increases the number of components and the number of working steps, resulting in less suitability for mass production.

SUMMARY OF THE INVENTION

Accordingly, a principal object of the present invention is to provide a dielectric resonator relatively simple in structure and suited for mass production and for improved temperature characteristic.

Briefly described, the present invention comprises a dielectric resonator including a cylindrical dielectric material and a case formed with a dielectric material of the same coefficient of linear expansion as that of the cylindrical dielectric material and having conductive films on the inner and outer surfaces thereof, and employing the $TM_{010}$ mode or a modified $TM_{010}$ mode thereof.

Since the inventive dielectric resonator is formed with a cylindrical dielectric material and a case of a dielectric material of the same coefficient of linear expansion as that of the cylindrical dielectric matieral, the cylindrical dielectric material and the case expand or contract in the same manner as the ambient temperature changes so that a minor gap between the end surface of the dielectric material and the case surface facing the same may be kept constant or such minor gap may be eliminated. Accordingly, the temperature characteristic of the resonance frequency of the resonator becomes extremely good. The fact that the coefficients of linear expansion of the cylindrical dielectric material and the case are the same brings about an ancillary advantage that a relative positional relation between the cylindrical dielectric material and the case is constant and hence a resonator of mechanical and electrical stability is provided. Furthermore, since a complicated structure for the case is not required to improve the temperature characteristic as in the conventional examples, the number of components and number of working steps can be decreased and the dielectric resonator is suited for mass production and is inexpensive.

In a preferred embodiment of the present invention, the cylindrical dielectric material and the case are formed integrally with dielectric materials of the same coefficients of linear expansion, coupled by a coupling portion. Therefore, according to the preferred embodiment of the present invention, integral formation of the cylindrical dielectric material and the case not only enhances the temperature characteristic but also reduces the number of working steps, providing an inexpensive dielectric resonator suited for mass production.

In another embodiment of the present invention, the portion facing at least one end of the cylindrical dielectric material is formed with a material of a good thermal conductivity or at least a portion of the outer surface of the case is covered with a rubber material of a good thermal conductivity. Therefore, according to this embodiment, heat dissipation of the dielectric resonator is improved, whereby an increase in the temperature of the whole is suppressed. As a result, a decrease in the no-load quality factor of the dielectric resonator can be prevented. Furthermore, in the case where at least a portion of the outer surface of the case is formed with a rubber material of a good thermal conductivity, an external force applied to the dielectric case portion is absorbed, resulting in less likelihood of the case being broken.

In a further preferred embodiment of the present invention, the resonance frequency can be adjusted with relative ease by inserting a frequency adjusting member made of a conductive material or a dielectric material in the direction parallel with or intersecting the center axis of the cylindrical dielectric material.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
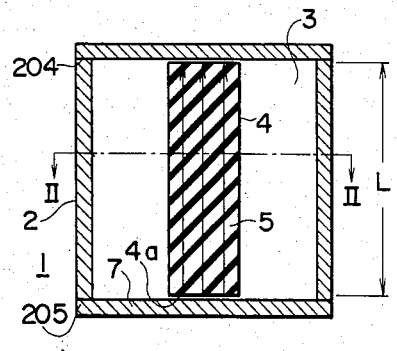
FIG. 1 PRIOR ART
FIG. 1 is a longitudinal sectional view of a conventional dielectric resonator employing the $TM_{010}$ mode.
Figure 2:
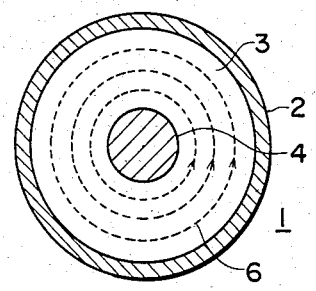
FIG. 2 PRIOR ART
FIG. 2 is a transverse sectional view of the dielectric resonator taken along the line II—II shown in FIG. 1.
Figure 3:
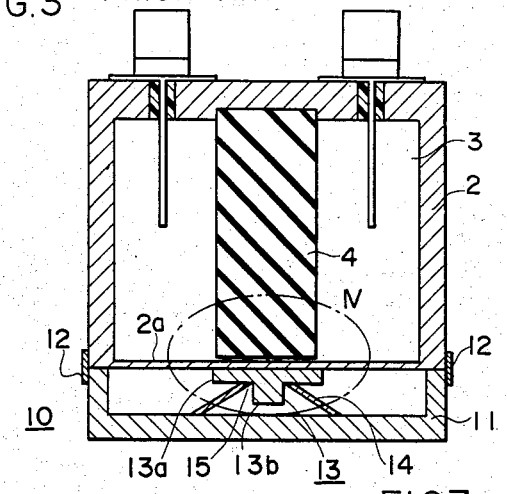
FIG. 3 PRIOR ART
FIG. 3 is a longitudinal sectional view of another conventional dielectric resonator.
Figure 4:
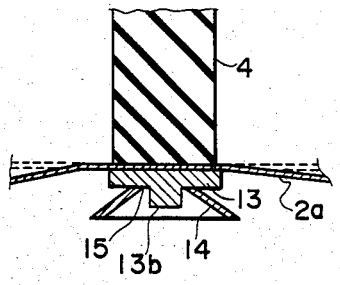
FIG. 4 PRIOR ART
FIG. 4 is a partial view of a portion enclosed by the line IV in FIG. 3.
Figure 7:
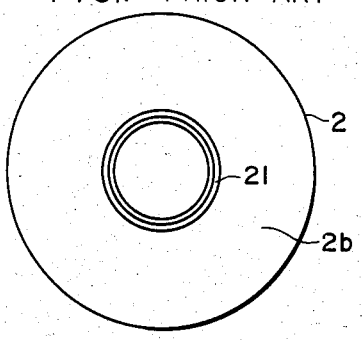
FIG. 7 PRIOR ART
FIG. 7 is a plan view of the case shown in FIG. 5.
Figure 5:
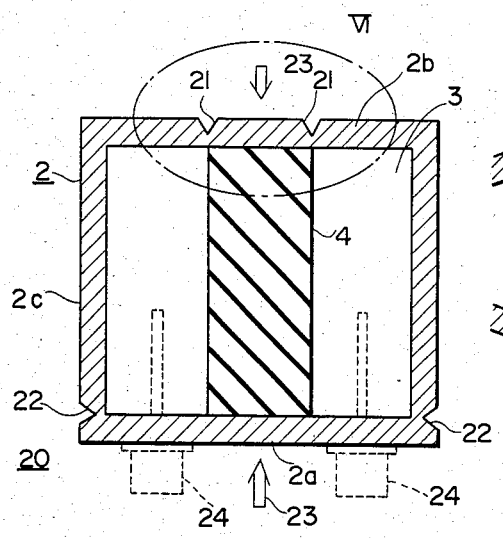
FIG.5 PRIOR ART
FIG. 5 is a longitudinal sectional view of another conventional example of a dielectric resonator.
Figure 6A:
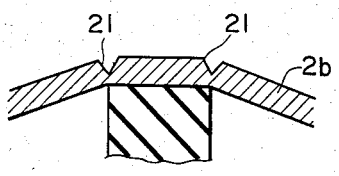
FIG.6A PRIOR ART
FIGS. 6A and 6B are a partial view of a portion enclosed by the line VI in FIG. 5.
Figure 6B:
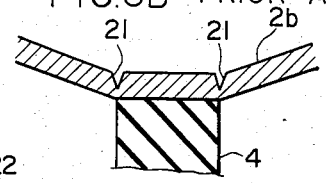
FIG.6B PRIOR ART
Figure 8:
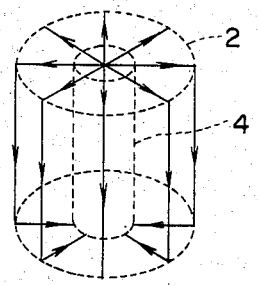
FIG8 PRIOR ART
FIG. 8 is a view showing a flow of a real current flowing through the conductive case of the dielectric resonator.
Figure 9:
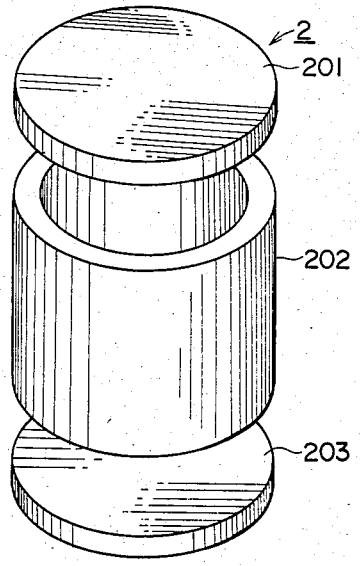
FIG.9 PRIOR ART
FIG. 9 is a perspective view of a conventional conductive case, as disassembled.
Figure 10:
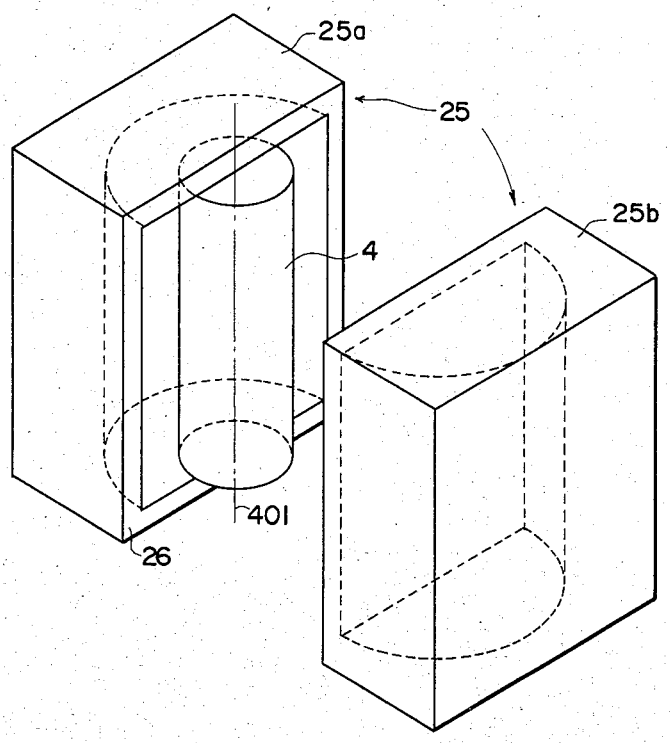
FIG.10 PRIOR ART
FIG. 10 is a perspective view of a conventional conductive case.
Figure 11A:
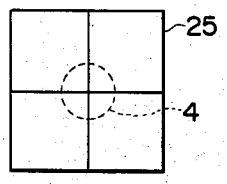
FIG.11A PRIOR ART
FIGS. 11A and 11B are views showing the manners of division of the conductive case.
Figure 11B:
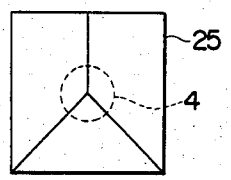
FIG.11B PRIOR ART
Figure 12:
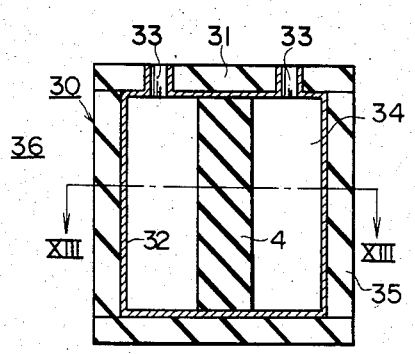
FIG. 12 is a longitudinal sectional view of one embodiment of the present invention.
Figure 13:
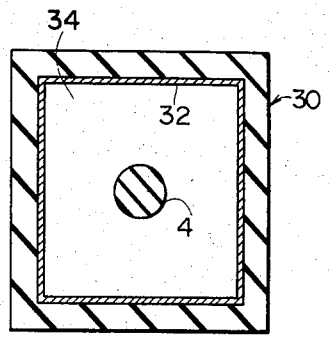
FIG. 13 is a transverse sectional view taken along the line XIII—XIII shown in FIG. 12.

FIGS. 12 and 13 are views showing one embodiment of the present invention. Specifically, FIG. 12 is a longitudinal sectional view of a dielectric resonator in accordance with one embodiment of the present invention and FIG. 13 is a transverse sectional view taken along the line XIII—XIII shown in FIG. 12.

Referring to FIGS. 12 and 13, a dielectric resonator 36 comprises a dielectric cylindrical portion 4 of the coefficient of linear expansion $\alpha$, for example, and a dielectric case portion 30 of the same coefficient of linear expansion $\alpha$ for allowing for disposition of the cylindrical portion 4 therein. Formation of the cylindrical portion 4 and the case portion 30 each of a dielectric material of the same coefficient of linear expansion is one of the essential features of the embodiment.

A conductive film 32 is formed on the whole inner surface of the dielectric case portion 30. Thus it follows that the dielectric cylindrical portion 4 is fully surrounded by the conductive film 32. In other words, the conductive film 32 formed on the whole inner surface of the dielectric case portion 30 forms a rectangular concavity 34, in which the dielectric cylindrical portion 4 is disposed. As a result of such structure, the conductive film 32 serves to correspond to a metallic case in a conventional resonator and hence serves as a shield and a real current path.

Now the conductive film 32 will be described in more detail. From the process for forming the same, the dielectric case portion 30 can be divided into at least a case upper lid 31 and a case main body 35 including a bottom portion and a side portion. The above described upper lid 31 and the main body portion 35 form in combination the case portion 30. In other words, the dielectric case portion 30 has an interface on the boundary between the upper lid 31 and the side surface of the main body portion 35, whereby the case portion 30 is discontinuous at that portion.

In the embodiment shown, after the dielectric cylindrical portion 4 is disposed in the dielectric case main portion 35, the upper lid 31 is placed thereon, to complete the dielectric case portion 30. The whole inner surface of the case portion 30 is coated with Ag (silver) paste and since the whole assembly is fired after the lid 31 is emplaced, a metal Ag film is formed on the inner surface of the case portion 30. The thickness of the Ag film is about 10 um or several tens of um. The above described metal Ag film, i.e. the conductive film 32, is also continuously formed at the discontinuous interface of the case portion 30, i.e. at a portion of intersection of the inner surface of the upper lid 31 and the inner surface of the case side portion, for example. By thus continuously forming the conductive film 32, an advantage is brought about that there is no joint in the real current path and there is no decrease in the quality factor Q of the resonator 36, whereby the value of the quality factor Q is attained as designed.

Meanwhile, insofar as the coefficients of linear expansion of the dielectric cylindrical portion 4 and the dielectric case portion 30 are the same, the dielectric constants thereof may be different.

Figure 14A:
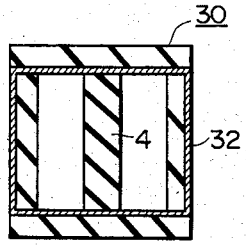
FIGS. 14A to 14C are views showing modifications of the embodiment shown in FIG. 12.
Figure 14B:
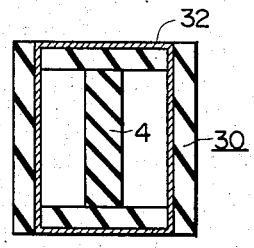
Figure 14C:
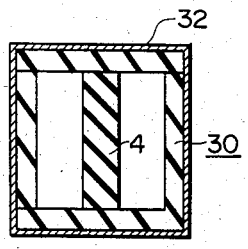

Although the embodiment of FIGS. 12 and 13 was adapted such that the conductive film 32 is formed on the whole inner surface of the dielectric case portion 30, the area of formation of the conductive film 32 is not limited to the inner surface of the case portion 30. More specifically, as shown in FIGS. 14A to 14C, the area of formation of the conductive film 32 may be any of the inner surface, the outer surface, and a combination of the inner surface and the outer surface of the case portion 30. In other words, the point is that the dielectric cylindrical portion 4 is completely enclosed with the conductive film 32 so that the conductive film 32 serves as a shield and a real current path corresponding to a conventional metallic case.

Meanwhile, in the embodiment shown in FIG. 12, two apertures 33 are formed on the case upper lid 31. As will be described subsequently, the apertures 33 are formed for providing input and output connectors when the resonator 36 is used as a filter.

Figure 15:
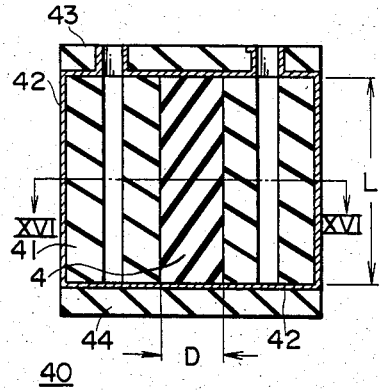
FIG. 15 is a longitudinal sectional view of another embodiment of the present invention.
Figure 16:
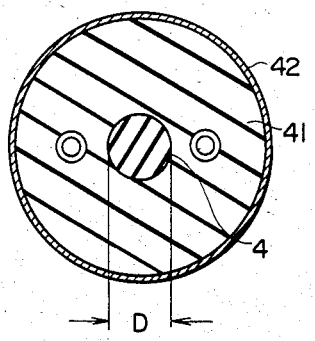
FIG. 16 is a transverse sectional view taken along the line XVI—XVI shown in FIG. 15.

FIGS. 15 and 16 are views showing another embodiment of the present invention and particularly FIG. 15 is a longitudinal sectional view of the embodiment, while FIG. 16 is a transverse sectional view taken along the line XVI—XVI shown in FIG. 15.

The essential feature of the embodiment shown in FIGS. 15 and 16 resides in disposition of the dielectric cylindrical portion 4 in close contact with the inner surface of the case side portion 41. More specifically, the dielectric cylindrical portion 4 (the diameter: D, the height: L) is disposed so as to just fit into the inside of the cylindrical concavity (the diameter: D, the height: L) formed in the case side portion 41.

Assuming that the dielectric constant of the dielectric cylindrical portion 4 is $\epsilon_1$ and the dielectric constant of the dielectric case side portion 41 is $\epsilon_2$, then the following relation is selected:

$\epsilon_1 < \epsilon_2$

Meanwhile, the coefficients of linear expansion of the dielectric cylindrical portion 4 and the case side portion 41 are both $\alpha$, and are equal to each other, as in the case of the previously described embodiment.

The conductive film 42 is formed continuously so as to cover the outer surface of the case side portion 41 and the end surface of the cylindrical portion 4. The dielectric case side portion 41 (the dielectric constant: $\epsilon_2$) supports the conductive film 42 and the dielectric cylindrical portion 4 (the dielectric constant: $\epsilon_1$) serves in the same manner as that of the concavity 34 (FIG. 13) of the previously described embodiment. Meanwhile, as shown in FIG. 15, the upper lid portion 43 and the lower lid portion 44 may be provided on the upper and the lower portions of the case side portion 41, for the purpose of reinforcement.

Since the embodiment described was structured in the above described manner, an advantage is brought about that there is no space inside the resonator 40 and hence an improved humidity response is obtained.

Incidentally, it is to be pointed out that the case of the present invention may be one which allows for insertion of the dielectric cylinder with the side surface thereof in close contact with inner surface of the case.

Since the coefficients of linear expansion of both the cylindrical dielectric portion and the case portion are selected to be the same value $\alpha$, the temperature characteristic $\eta_f$ of the resonance frequency is always expressed by the following equation (2).

$$\eta_f = C\eta_\epsilon - \alpha = (-\tfrac{1}{2})\eta_\epsilon - \alpha (C \approx -\tfrac{1}{2}) \qquad (2)$$

Therefore, according to the embodiment, after the value $\eta_\epsilon$ is determined by selecting the dielectric material, the value $\eta_f$ can be determined by controlling only the coefficient $\alpha$ of linear expansion. This can be done with relative ease. More specifically, the temperature characteristic $\eta_f$ of the resonance frequency can be enhanced primarily merely by selecting the dielectric materials. Meanwhile, the equation $C = -\frac{1}{2}$ is met when 100% of the resonance energy is trapped in the dielectric cylindrical portion.

Although the above described embodiments were implemented as a combination of the dielectric case having the rectangular concavity 34 and the dielectric cylindrical portion 4, as seen in FIGS. 12 and 13, or as a combination of the cylindrical case 41 and the dielectric cylindrical portion 42, as seen in FIGS. 15 and 16, the present invention is not limited thereto and the present invention can be embodied as a combination of the rectangular concavity case (a square pillar case) and a dielectric square pillar portion, a combination of the rectangular concavity case (a square pillar case) and a dielectric cylindrical portion, a combination of a cylindrical concavity case (a cylindrical case) and a dielectric square pillar portion, and the like. If and when the shapes of the case and the pillar portion are changed, a modified mode having similar electromagnetic field distribution and resonance frequency is attained as compared with the fundamental $TM_{010}$ mode.

The embodiments described in conjunction with FIGS. 12 to 16 have the end surface of the dielectric cylindrical portion 4 in electrical contact with the conductive film 32 or 42. An embodiment for keeping these portions in closer electrical contact will be described in the following.

FIGS. 17A to 17D and FIGS. 18A to 18C are views showing the end portion of the dielectric cylindrical portion 4 shown in FIGS. 12 and 15.

Figure 17A:
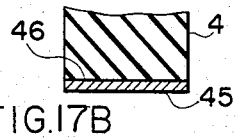
FIGS. 17A to 17D and FIGS. 18A to 18C are views showing the end portions of the dielectric cylindrical portions shown in FIGS. 12 to 15.
Figure 17B:
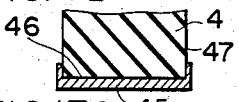
Figure 17C:
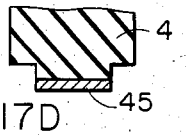
Figure 17D:
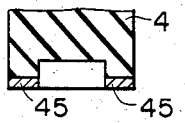
Figure 18A:
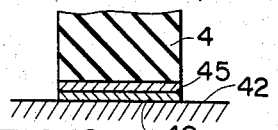
Figure 18B:
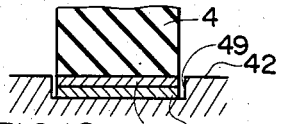

As shown in FIG. 17A, an electrode film 45 is formed on the end surface 46 of the dielectric cylindrical portion 4. The electrode film 45 may be formed only on the end surface 46 of the dielectric cylindrical portion 4, as shown in FIG. 17A, or alternatively the same may be formed to lie not only on the end surface 46 of the dielectric cylindrical portion 4 but also to lie over the side surface 47 of the dielectric cylindrical portion 4, as shown in FIG. 17B. Alternatively, as shown in FIG. 17C, the end surface of the dielectric cylindrical portion 4 may be processed to be stepped and the electrode film 45 may be formed only on the central area protruding from the peripheral end surface of the dielectric cylindrical portion 4. Conversely, as shown in FIG. 17D, a recess may be formed at the center of the end surface of the dielectric cylindrical portion 4 and the electrode film 45 may be formed only on the peripheral end surface protruding from the central recessed surface. In order to make the dielectric cylindrical portion 4 and the electrode film 42 in much closer electrical contact, the electrode film 45 may be brazed or soldered as shown at 48 to the metallic case surface 42, as shown in FIG. 18A. Alternatively, as shown in FIG. 18B, a recess 49 may be formed on the metal case surface connecting to the electrode film 45 and the electrode film 45 may be brazed or soldered as 48 to the recessed surface. By thus forming the recess 49 in the metal surface 42, an advantage is brought about that the dielectric cylindrical portion 4 can be readily positioned for connection.

Figure 18C:
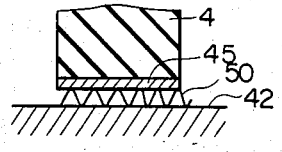

Alternatively, as shown in FIG. 18C, the electrode film 45 may be electrically connected to the metal case surface 42 using a metallic corrugated plate 50. Since the corrugated plate 50 itself has elasticity, the dielectric cylindrical portion 4 is elastically supported. As a result, a slight dimensional difference between the metal case 42 and the dielectric cylindrical portion 4 is advantageously absorbed. The corrugated plate 50 may be replaced by anything that serves to transfer on electric current from the electrode film 45 to the metal case 42, such as a metallic net.

By thus forming the electrode film 45 on the end surface of the dielectric cylindrical portion 4, a displacement current occurring inside the dielectric cylindrical portion 4 is caused to flow into the electrode film 45 without being concentrated, so that the same turns to a real current. Accordingly, the effective dielectric constant of the dielectric cylindrical portion 4 does not change and hence the resonance frequency $f_0$ of the resonator can be kept stable.

Figure 20:
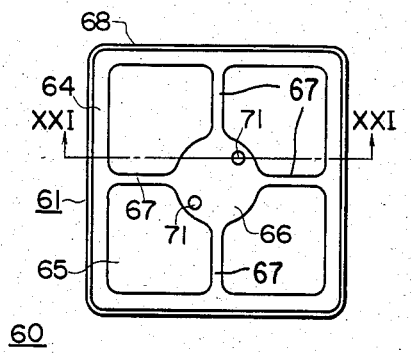
FIG. 20 is a plan view of a resonator main body portion of the resonator shown in FIG. 19, with the upper and lower lids removed.
Figure 19:
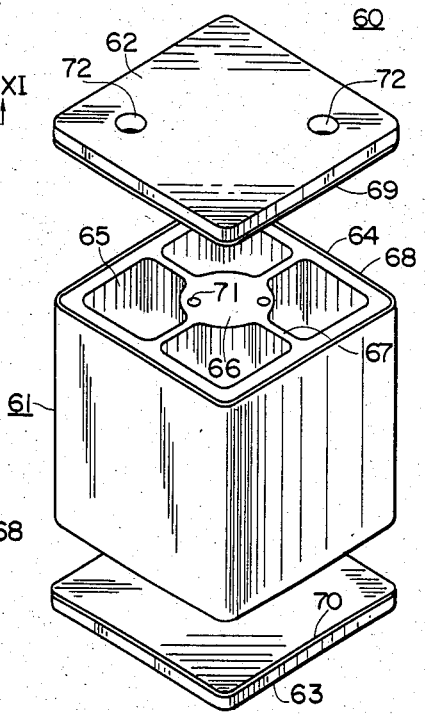
FIG. 19 is a perspective view of a further embodiment of the present invention.
Figure 21:
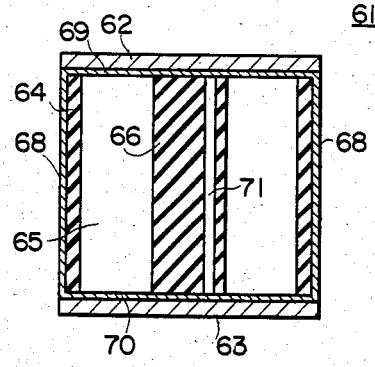
FIG. 21 is a longitudinal sectional view taken along the line XXI—XXI in FIG. 20.

FIGS. 19 to 21 are views showing a further embodiment of the present invention. Particularly, FIG. 19 is a perspective view of the dielectric resonator, FIG. 20 is a plan view of the dielectric resonator main portion 61 with the upper and lower lids 62 and 63 removed, and FIG. 21 is a longitudinal sectional view taken along the line XXI—XXI shown in FIG. 20.

Referring to FIGS. 19 to 21, the dielectric resonator 60 comprises the resonator main portion 61, and the upper and lower lids 62 and 63. The main portion 61 comprises the dielectric case side portion 64, and the dielectric cylindrical portion 66 concentrically disposed in the concavity 65 formed by the case side portion 64, with these coupled by the four connecting portions 67, thereby to achieve an integrated implementation. Thus, the main body portion 61 comprises the case side portion 64 and the cylindrical portion 66 formed simultaneously and integrally with the same dielectric material. This is one of the features of the embodiment in description. The conductive film 68 is formed on the whole outer peripheral surface of the dielectric case side portion 64 of the main body portion 61. Furthermore, the conductive films 69 and 70 are formed both on the lower surface of the upper lid 62 and on the upper surface of the lower lid 63. When these lids are fitted onto the main body portion 61, a shield and a real current path corresponding to a conventional metallic case are formed by means of these conductive films 69 and 70 and the conductive film 68 on the peripheral surface of the main body portion 61.

Meanwhile, although the embodiment was adapted such that the conductive films 69 and 70 are formed on the lower surface of the upper lid 62 and on the upper surface of the lower lid 63, conversely the conductive films may be formed on the upper and side surfaces of the upper lid 62 and on the lower and side surfaces of the lower lid 63 so that when the lids 62 and 63 are fitted into the main body portion 61 the respective conductive films may confine the dielectric cylindrical portion 66. Although another approach may be considered in which the conductive film 68 of the dielectric case side portion 64 is formed on the inner wall of the dielectric case side portion 64, such approach is not practical in that the coupling portion 67 makes the conductive film discontinuous, thereby to cause leakage of an electromagnetic wave therefrom.

Although the embodiment is structured such that the dielectric case side portion 64 and the dielectric cylindrical portion 66 are integrally formed with four coupling portions 67, the coupling portions 67 may be formed at two symmetrical positions or alternatively at one position or otherwise.

At least a portion of the case (including the upper lid, the lower lid and the side portion) formed to be integral with the dielectric cylindrical portion 66 may be formed to be integral not only with the dielectric case side portion 64 but also with the upper lid, the lower lid and the dielectric cylindrical portion 66.

Meanwhile, the embodiment shown in FIGS. 19 and 21 has two apertures 71 formed extending in the axial direction of the dielectric cylindrical portion 66 for the purpose of fine adjustment of the resonance frequency $f_0$ of the resonator 60. By inserting dielectric materials of the dielectric constant which is identical to or different from that of the cylindrical portion 66 into these apertures 71, the resonance frequency $f_0$ can be changed as a function of the extent of insertion.

Meanwhile, the apertures 72 formed on the upper lid 62 shown in FIG. 19 are used for applying a connector when the resonator 36 is ued as a filter, as will be described subsequently.

Figure 22:
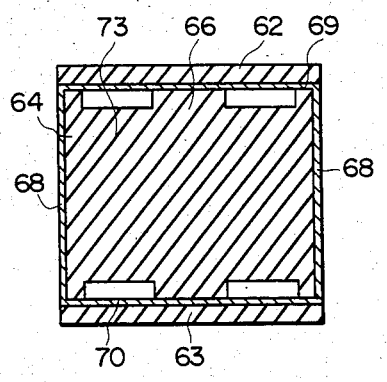
FIG. 22 is a view showing a modification of the resonator shown in FIG. 19.

FIG. 22 is a view showing a modification of the resonator shown in FIGS. 19 to 21. The embodiment shown in FIG. 22 has the coupling portion 67 shown in FIG. 19 formed not for the full length of the cylindrical portion 66 but for only a portion of the length thereof. More specifically, the coupling portion 73 is formed such that one and the other ends of the cylindrical portion 66 may be recessed.

Figure 23:
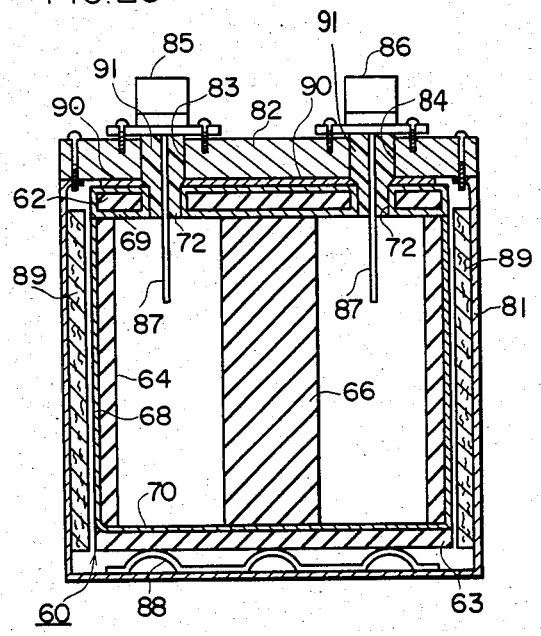
FIG. 23 is a longitudinal sectional view of a one-stage dielectric filter employing the resonator shown in FIG. 19.

FIG. 23 is a sectional view showing one example of a filter employing a preferred embodiment of the present invention. Referring to FIG. 23, the dielectric resonator 60 is inserted into the outer case 81 and is sealed with the outer lid 82. The outer lid 82 has two apertures 83 and 84 in it and the input connector 85 and the output connector 86 of a coaxial type fixed into these apertures 83 and 84. The exciting rods 87 are provided to protrude from the respective connectors 85 and 86 extending through the apertures 72 of the resonator into the resonator 60 in the outer case 81. A material 91 such as Teflon (trademark), for example, fills the space between the exciting rods 87 and the apertures 83 and 84 of the outer lid 82 and the apertures 72 of the resonator 60 for the purpose of preventing humidity from entering. These exciting rods 87 are combined with the resonator 60, so that only a signal of a predetermined frequency f inputted through the input connector 85 is outputted through the output connector 86.

The spring 88 is provided at the bottom of the outer case 81, so that the spring 88 may elastically support the resonator 60. Any vibration or the like applied to the resonator 60 from outside of the outer case 81 is mitigated by the spring 88 and any expansion or contraction of the outer case 81 due to a change of the ambient temperature is also absorbed by the spring 88, thereby to stably support the resonator 60. A cushion member 89 made of felt, for example, is provided on the inner side surface of the outer case 81, so that vibration given to the inside resonator 60 may be decreased.

The conductive films 69 of the upper lid 61 and the outer lid 82 of the resonator 60 are electrically connected to the ground plate 90, together with the outer conductors, not shown, of the connectors 85 and 86.

Figure 24:
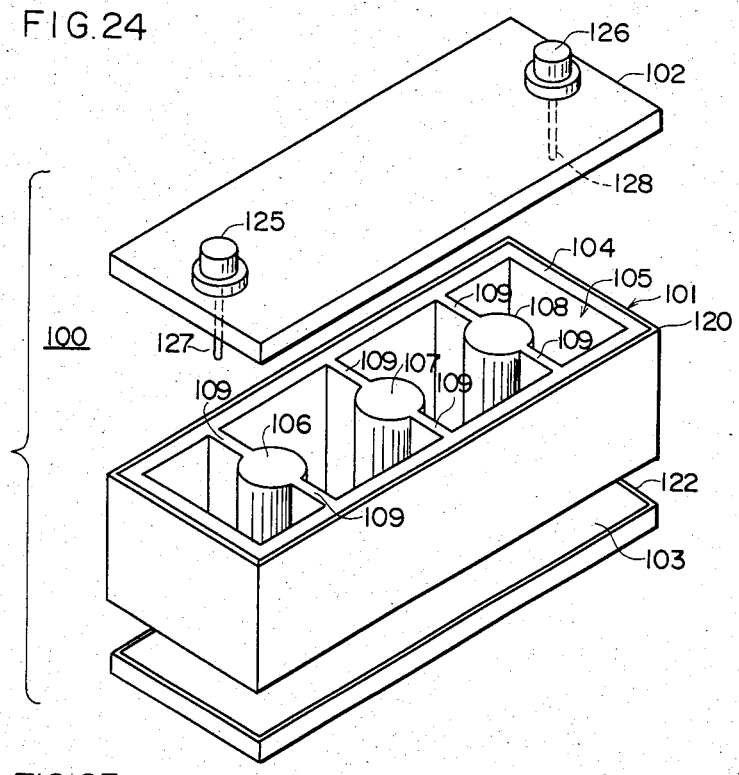
FIG. 24 is a perspective view of still a further embodiment of the present invention.
Figure 25:
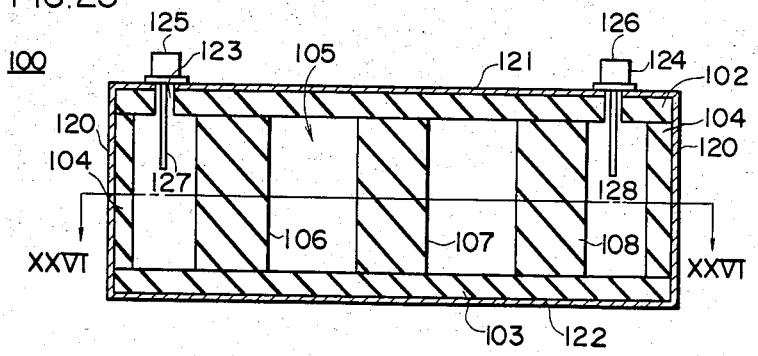
FIG. 25 is a longitudinal sectional view of the embodiment shown in FIG. 24.
Figure 26:
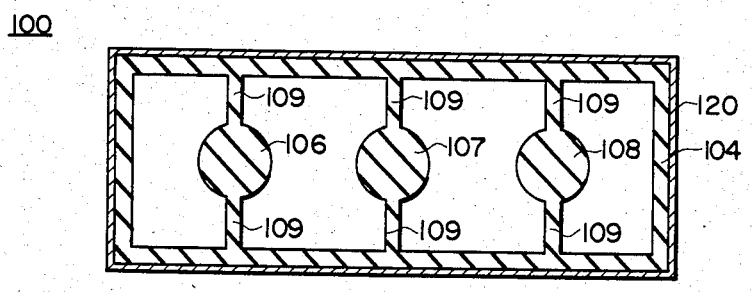
FIG. 26 is a transverse sectional view taken along the line XXVI—XXVI shown in FIG. 25.

FIGS. 24 to 26 are views showing a further embodiment of the present invention. Specifically, FIG. 24 is a perspective view of a three-stage dielectric filter, with the upper lid 102 and the lower lid 103 disassembled, for facility of observing the inner structure of the filter main body portion 101, FIG. 25 is a longitudinal sectional view of the embodiment shown in FIG. 24, and FIG. 26 is a transverse sectional view taken along the line XXVI—XXVI shown in FIG. 25.

Referring to FIGS. 24 to 26, the three-stage dielectric filter 100 comprises the filter main body portion 101, the upper lid 102 and the lower lid 103. The filter main body portion 101 comprises the dielectric case side portion 104, and three dielectric cylindrical portions 106, 107 and 108 disposed in the concavity 105 formed in the case side portion 104, in which each of the dielectric cylindrical portions 106, 107 and 108 is coupled to the case by two coupling portions 109, so that the dielectric cylindrical portions may be formed to be integral with the case side portion 104. Thus, the filter main body portion 101 comprises the case side portion 104 and the three cylindrical portions 106, 107 and 108 formed simultaneously and integrally with the same dielectric material. This is one of the essential features of the embodiment. The conductive film 120 is formed on the whole outer surface of the dielectric case side portion 104. Furthermore, the conductive films 121 and 122 are formed both on the upper and side surfaces of the upper lid 102 and the lower and side surfaces of the lower lid 103. When the respective lids 102 and 103 are mounted, these conductive films 121 and 122 and the conductive film 120 of the outer surface of the main body portion 101 together form a shield and real current path corresponding to a conventional metallic case.

The input connector 125 and output connector 126 of a coaxial type are mounted into the apertures 123 and 124 formed in the vicinity of the respective extremities in terms of the length direction of the upper lid 102. The exciting rods 127 and 128 are provided to protrude inward of the filter main body portion 101 through the apertures 123 and 124 of the upper lid 102 from the respective connectors 125 and 126. The exciting rod 127 of the input connector 125 is coupled to the dielectric cylindrical portion 106 and the exciting rod 128 of the output connector 126 is coupled to the dielectric cylindrical portion 108. A signal inputted to the input connector 125 from an external circuit, not shown, is subjected to filtration passing only a signal of a predetermined frequency f through predetermined electromagnetic coupling between the exciting rod 127, the dielectric cylindrical portions 106, 107 and 108 and the exciting rod 128, so that only the signal of the predetermined frequency f is outputted from the output connector 126.

Although the above described embodiment was adapted such that the conductive films 121 and 122 are formed on the upper and side surfaces of the upper lid 102 and the lower and side surfaces of the lower lid 103, alternatively the conductive films may be formed on the lower surface of the upper lid 102 and on the upper surface of the lower lid 103. More specifically, the embodiment may be structured such that when the lids 102 and 103 are combined with the filter main body portion 101 the dielectric cylindrical portions 106, 107 and 108 may be confined by the respective conductive films. Although an approach may be considered in which the conductive film 120 of the dielectric case side portion 104 is formed on the inner wall of the case, such approach is not practical in that the coupling portions 109 make the formed conductive films discontinuous, thereby to cause leakage of an electromagnetic wave therefrom. However, such problem can be eliminated by providing an outer shield case.

Although the above described embodiment was structured such that the dielectric case side portion 104 and the dielectric cylindrical portions 106, 107 and 108 are formed to be integral by means of the two coupling portions 109, only one coupling portions 109 may be formed, for example.

The coupling portions 109 need not be formed to the full length to be continuous in the length direction of the cylindrical portions 106, 107 and 108 and alternatively these may be formed only for a portion of the full length.

Figure 27:
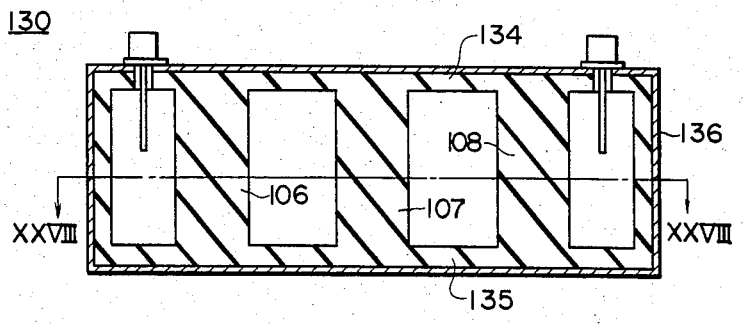
FIG. 27 is a longitudinal sectional view showing a modification of the embodiment shown in FIG. 25.
Figure 28:
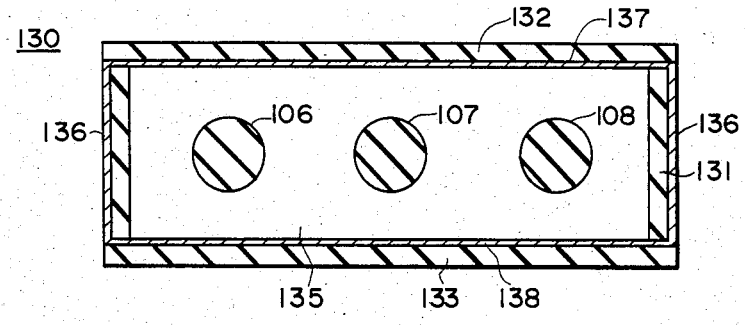
FIG. 28 is a transverse sectional view taken along the line XXVIII—XXVIII shown in FIG. 27.

FIGS. 27 and 28 are views showing still a further embodiment of the present invention. FIG. 27 is a longitudinal sectional view of a three-stage dielectric filter, and FIG. 28 is a transverse sectional view taken along the line XXVIII—XXVIII shown in FIG. 27.

In comparison with the embodiment shown in FIGS. 24 to 26, the embodiment shown in FIGS. 27 and 28 is different in that the dielectric filter 130 comprises the main body portion 131 and the left and right side walls 132 and 133. The dielectric cylindrical portions 106, 107 and 108 disposed inside the main body portion 131 are coupled to the upper wall portion 134 and the lower wall portion 135 of the case of the main body portion 131 at the respective end surfaces, so that the same may be formed to be integral with the case portion. This is an essential feature of the embodiment.

The conductive film 136 is formed on the whole outer surface of the main body portion 131 and the conductive films 137 and 138 are formed also on the inner surfaces of the left and right side walls 132 and 133, so that the dielectric cylindrical portions 106, 107 and 108 may be enclosed.

Since the other portions are structured in substantially the same manner as that of the previously described embodiments, the like or same portions are denoted by the same reference characters and a more detailed description will be omitted.

With reference to the embodiment shown in FIGS. 27 and 28, the position of formation of the conductive films on the case portion is not limited to the surface as shown, as in the case of the previously described embodiments, and the conductive films may be formed continuously on the surface enclosing the dielectric cylindrical portions 106, 107 and 108, as is a matter of course.

As seen from FIGS. 24 to 28, although the above described embodiments were structured such that all of the pillar dielectric materials were shaped to be cylindrical, this should not be taken by way of limitation and the pillar dielectric materials may be in the form of a square pillar, for example.

It is further pointed out that the three-stage dielectric filter as employed in the previously described embodiments should not be taken by way of limitation and the present invention can also be applied to a filter including an arbitrary number of pillar dielectric materials.

Furthermore, the dielectric filter having three or more stages may be structured such that the dielectric cylindrical portion at both ends are formed as a dielectric pillar of the $TM_{010}$ mode, and the dielectric cylindrical portions other than both ends are formed as the $TE_{01\delta}$ dielectric, so that a so-called $TM_{010}$, $TE_{01\delta}$ mode hybrid dielectric filter may be provided. By employing such structure, a resonator employing the $TE_{01\delta}$ mode can be provided in which exciting rods are strongly coupled to the pillar dielectric material at both ends and the pillar dielectric material at an intermediary position has the high quality factor Q.

Figure 29:
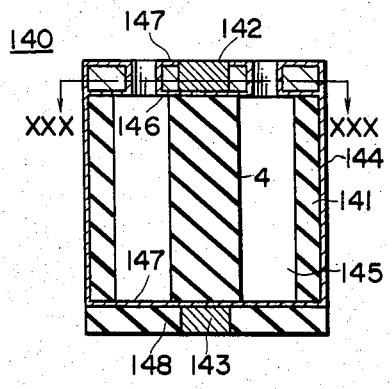
FIG. 29 is a longitudinal sectional view of still a further embodiment of the present invention.
Figure 30:
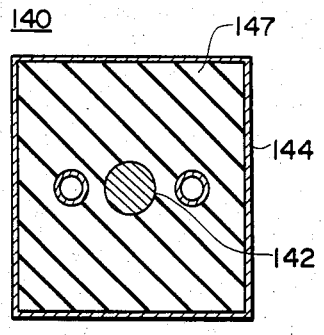
FIG. 30 is a transverse sectional view taken along the line XXX—XXX of the embodiment shown in FIG. 29.

FIG. 29 is a longitudinal sectional view of still a further embodiment of the present invention and FIG. 30 is a transverse sectional view taken along the line XXX—XXX shown in FIG. 29.

The embodiment shown in FIGS. 29 and 30 aims to improve dissipation of the heat in view of the fact that when the case is formed with a dielectric material dissipation of the heat is poor due to a small thermal conductivity of the dielectric material and hence the temperature of the resonator as a whole is likely to increase.

Referring to FIGS. 29 and 30, the dielectric resonator 140 comprises the dielectric cylindrical portion 4 and the case portion 141 disposed inside the cylindrical portion 4. The case portions 142 and 143 facing both ends of the cylindrical dielectric material 4 are formed with a material of good thermal conductivity, such as aluminum, duralumin or the like, while the remaining portion is formed with a dielectric material. This is one of the essential features of the embodiment shown.

The conductive film 141 is continuously formed on the inner or outer surface of the dielectric case portion 141. The dielectric cylindrical portion 4 is completely surrounded by the conductive film 144. In other words, the conductive film 144 continually formed on the inner or outer surface of the dielectric case portion 141 forms a rectangular concavity 145, in which the dielectric cylindrical portion 4 is disposed. As a result, the conductive film 144 serves as a shield and a real current path corresponding to a metallic case of a conventional resonator.

Meanwhile, although in a resonator, heat is generated inside the pillar dielectric material 4 and in the conductive films 146 and 147, such heat is not dissipated well due to poor thermal conductivity of a dielectric material, if and when the case portion 141 is formed wholly of a dielectric material. As a result, the portions of the conductive films 146 and 147 become elevated in temperature. In order to eliminate this, therefore, the embodiment is structured such that the portions of the case facing both ends of the pillar dielectric material 4 are partially made of a material of good thermal conductivity. As a result, the heat generated inside the cylindrical portion 4 and the heat generated in the conductive films 146 and 147 are dissipated through the case portions 142 and 143. Accordingly, the dissipation of heat of the dielectric resonator is improved and an increase of the temperature in the resonator is eliminated. Thus an increase of a dielectric loss of the dielectric material having temperature dependency is avoided and hence a decrease of the no-load quality factor is prevented. Furthermore, since the remaining portion of the case portion 141 is formed with the same dielectric material as that of the cylindrical portion 4, the disadvantage is eliminated that the temperature characteristic of the resonance frequency is poor due to a difference in the coefficients of linear expansion between the cylindrical portion 4 and the case portion 141.

Preferably, the case portions 142 and 143 formed with a material of good thermal conductivity facing the cylindrical portion 4 are shaped to be of a diameter slightly smaller than the diameter of the end surfaces of the cylindrical portion 4 (see FIG. 29). In this way, the pillar dielectric material 4 is fixed so as to face the case portions 147 and 148 of the dielectric material 4 at least at the end periphery and an advantage is brought about that the cylindrical portion 4 can be supported more stably.

Preferably the thickness of the conductive films 146 and 147 coupled to both end surfaces of the cylindrical portion 4 are selected to be sufficiently large. As a result, the current flowing into the conductive film 144 does not flow into the case portions 142 and 143, and the flow of the current becomes smooth. Hence the no-load quality factor Q of the resonator is not decreased.

Figure 31:
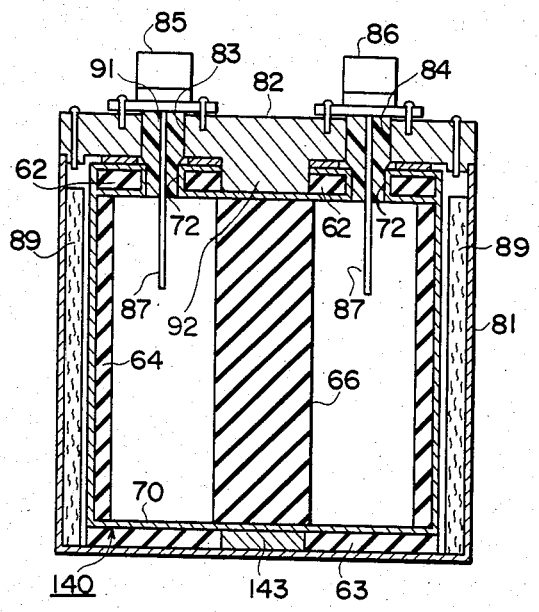
FIG. 31 is a longitudinal sectional view showing one example of a filter employing the embodiment shown in FIG. 29.

FIG. 31 is a longitudinal sectional view of one example of a filter employing the embodiment shown in FIG. 29. The filter shown in FIG. 31 is substantially the same as the filter shown in FIG. 29, except in the following respects. More specifically, the filter shown in FIG. 31 comprises the portion 92 of the upper lid 62 facing the upper end portion of the cylindrical portion 66, said case portion 92 being formed to be integral with the outer lid 82 of the outer case 81. As a result of such structure, the heat generated inside the dielectric resonator 140 is dissipated externally through the outer lid 82, whereby an increase in the temperature of the dielectric resonator 140 can be effectively prevented. Furthermore, necessity of a particular step of fabricating the portion 92 of the dielectric resonator 140 is eliminated, whereby simplification of the process is achieved.

Meanwhile, integral formation may be made out only with the portion 92 facing the upper end portion of the cylindrical portion 66 but also with the outer case 81 of the lower lid 143. With such structure, heat dissipation will be further improved.

Figure 32:
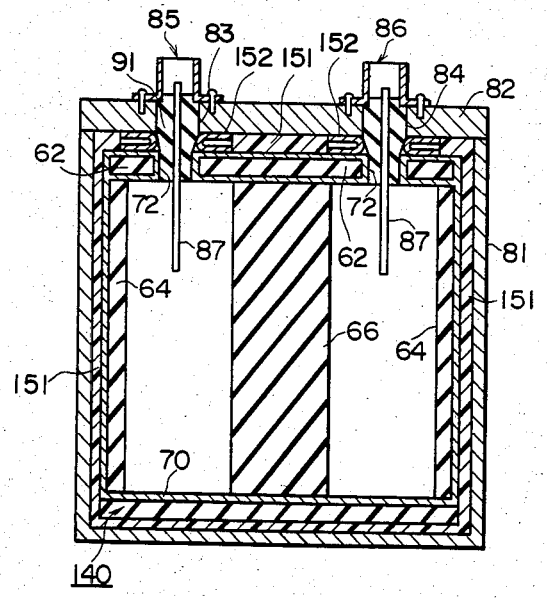
FIG. 32 is a view showing another embodiment of the filter.

FIG. 32 is a longitudinal sectional view showing a further example of the filter. The filter shown in FIG. 32 is also substantially the same as the example shown in FIG. 23 except for the following respects. More specifically, almost the whole surface of the resonating unit 140 is covered with a rubber 151 of good thermal conductivity in close contact therewith and the resonating unit 140 thus covered with the rubber 151 is housed in the metallic outer case 81 in close contact, whereupon the metallic upper lid 82 is mounted. This is one of the essential features of the embodiment.

Since the resonating unit 140 and the metallic outer case 81 are kept in close contact with each other by means of a rubber 151 of good thermal conductivity, the heat generated by the resonating unit 140 is conducted efficiently to the rubber 151 from the outer surface of the resonating unit 140 and further conducted efficiently from the rubber 151 to the outer case 81, whereupon the heat is dissipated smoothly.

Employment of the rubber is based on the following theory and experimentation. More specifically, superficially it is considered that connection of the resonating unit 140 to the metallic outer case 81 will provide better heat dissipation. Assuming that the two metals are placed in contact with each other and the temperature difference between these metals is $\Delta\theta$, then the following equation is established:

$$\Delta\theta=(W\cdot\Omega)/(\rho\cdot\lambda)$$

where

W: consumed power $\Omega$: contact resistance $\rho$: specific resistance $\lambda$: thermal conductivity Referring to the above described equation, $\rho\cdot\lambda$ is constant in the light of the Wiedemann-Franz law. Therefore, it can be said that the smaller the contact resistance $\Omega$ between the metals the better the thermal conductivity between the metals. However, it is difficult to achieve facial contact by bringing two metals in close contact and the result of experimentation revealed that in the case of this resonator the contact resistance $\Omega$ cannot be made smaller than $\Omega=0.01$ (m$\Omega$) as a whole.

On the other hand, if and when a rubber is employed, the temperature difference $\Delta\theta$ between the rubber and the metal is expressed by the following equation:

$$\Delta\theta=(W\cdot d)/(S\cdot\lambda)$$

where

W: consumed power d: the thickness of rubber

S: contact surface $\lambda$: thermal conductivity

In the case of rubber, even if a rubber of good thermal conductivity is employed, the thermal conductivity of the rubber becomes smaller than that of a metal by the order of 10 to $10^2$; however, it is possible to decrease the thickness d and increase the contact surface S. The reason is that a rubber can be expanded to be thinner and the same may be brought in close contact with the metal surface. As a result, it was observed that the temperature difference $\Delta\theta$ can be decreased by the order of 10 to $10^2$ as compared with that in the case of the metal.

The described embodiment employed, as the rubber 151 of good thermal conductivity, the product of Fujikura Kasei named "Cool Sheet (trademark)" (having thermal conductivity of 0.013 cal/cm.sec.°C.). However, from a practical standpoint, a rubber material with thermal conductivity of 0.001 cal/cm.sec.°C. may be used.

A metallic ring 152 is disposed on the upper surface of the resonating unit 140 so as to enclose the above described Teflon. The metallic ring 152 serves to electrically connect the upper surface of the resonating unit 140 and the outer lid 82. Since the metallic ring 152 is shaped as a ring of the letter U at the end surface, as shown, the ring 152 has elasticity and it is possible to electrically connect the resonating unit 140 and the upper lid 82.

Since the rubber 151 is inserted between the resonating unit 140 and the outer case 81, an external stress applied to the outer case 81 is absorbed by the elasticity of the rubber 151, thereby to bring about an advantage that the resonating unit 140 is unlikely to be broken.

Since the resonating unit 140 is covered with the rubber 151 in the described embodiment, the cushion member 89 shown in FIG. 23 has been omitted.

Figure 33:
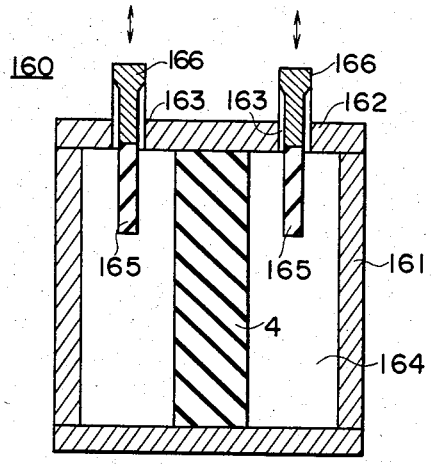
FIG. 33 is a longitudinal sectional view of still a further embodiment of the present invention.
Figure 34:
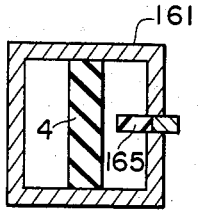
FIGS. 34, 35, 36 and 37 are views showing modifications of the embodiment shown in FIG. 33.

FIG. 33 is a longitudinal sectional view of still a further embodiment of the present invention. The feature of the embodiment is that two apertures 163 are formed in the upper plate 162 of the metallic case 161 so as to allow for insertion of the dielectric rods 165 of circular cross-section into the concavity 164 in the metallic case 161 through the above described apertures 163. More specifically, the apertures 163 formed on the case upper plate 162 are threaded and the dielectric rods 165 having the metallic portions 166 threaded on the outer surface are inserted therethrough by screwing the same. The amount of insertion of the dielectric rods 165 to be inserted into the concavity 164 can be adjusted through rotation of the dielectric rods 165. Although an alternative approach may be considered in which the thread is directly formed on the dielectric rods 165 without employing metallic portions 166 in the dielectric rods 165, it is difficult to process the dielectric rods 165 in such shape and such is not practical.

As a result of the above described structure, by adjusting the insertion amount of the dielectric rods 165 into the concavity 164, the resonance frequency $f_0$ of the resonator 160 can be changed. The reason is that the electric field exists within the concavity 164 defined by the metallic case 161 and insertion of the dielectric rods 165 into the concavity 164 causes a change in the electric field in the region where the rods are inserted, thereby causing a change in the whole effective dielectric constant. In other words, assuming that the intensity of the electric field before insertion of the dielectric rods 165 into the concavity 164 is $E_1$ and the effective dielectric constant at that time is $\epsilon_1$, and the intensity of the electric field after insertion of the dielectric rods 165 into the concavity 164 is $E_2$ and the effective dielectric constant at that time is $\epsilon_2$, then the following equation is obtained:

$$-(\Delta\omega_0/\omega_0)\approx\{(\tfrac{1}{2})(\epsilon_2-\epsilon_1)\int E_1\cdot E_2^*dV\}/W_T$$

where $\omega_0=2\pi f_0$ $\Delta\omega_0$=a variation of $\omega_0$ $W_T$=the total resonating energy

*=a conjugate complex number

Thus, by adjusting the amount of insertion of the dielectric rods 165, $(\epsilon_2-\epsilon_1)$ is changed and the resonance frequency $f_0$ can be changed.

Meanwhile, assuming that the temperature coefficient of the dielectric constant of the dielectric rods 165 to be inserted is different from the temperature coefficient of the dielectric constant of the cylindrical dielectric material 4, then another advantage is brought about that the temperature characteristic of the resonance frequency $f_0$ can be improved. More specifically, the temperature coefficient of the effective dielectric constant exerting an influence upon the temperature characteristic of the resonance frequency can be improved by properly selecting the temperature coefficient of the dielectric rods 165 thereby to offset or reinforce the same of the cylindrical dielectric material 4.

FIGS. 34 to 37 are views showing still a further embodiment of the present invention. As shown in the figures, the position for insertion of the dielectric rods into the metallic case 161 is not limited to at the case upper plate 162 but may be at the side portion of the case (see FIGS. 34 and 37).

Figure 35:
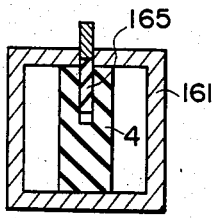
Figure 36:
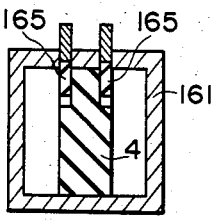
Figure 37:
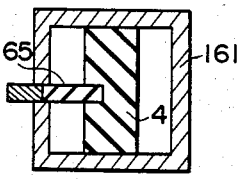

The dielectric rods 165 may be inserted to avoid the position of the cylindrical dielectric material 4 or alternatively may be inserted into the cylindrical dielectric material 4 (see FIGS. 35 and 36). The number of the dielectric rods 165 may be not only two but also one or three or more, as a matter of course (see FIGS. 34, 35 and 37).

Meanwhile, fixing of the dielectric rods (not limited to circular in section) to the metallic case 161 after insertion thereof may be made not using screws but using fixing pins, an ahesive agent or the like after proper insertion of the dielectric rods into the apertures formed in the metallic case 161, for example.

Figure 38:
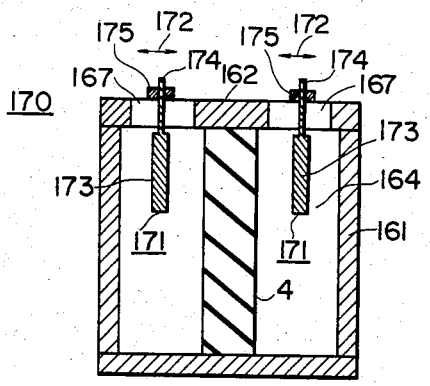
FIG. 38 is a longitudinal sectional view of still a further embodiment of the present invention.
Figure 39:
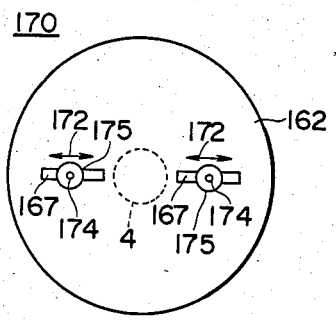
FIG. 39 is a plan view of the embodiment shown in FIG. 38.

FIG. 38 is a longitudinal sectional view of still a further embodiment of the present invention and FIG. 39 is a plan view of the embodiment shown in FIG. 38. The embodiment is characterized in that the two slits 167 are formed on the upper plate 162 of the metallic case 161 so as to be symmetrical with respect to the cylindrical dielectric material 4 at the center and the metallic rods 171 for adjusting the resonance frequency are inserted into these slits 167. The metallic rods 171 are inserted so as to be movable in a direction intersecting the center axis of the pillar dielectric material 4, i.e. in the direction of the arrow 172 along the slits 167. Since the above described slits 167 serve to interrupt a real current at that portion, it is desired that the width of these slits 167 is selected to be as small as possible so as not to decrease the no-load quality factor Q.

More specifically, the metallic rods 171 each comprise a main body portion 173 of circular section and of a diameter larger than the width of the slits 167, and a fixing portion 174 for insertion into the slit 167. The fixing portion 174 is threaded and a nut 175 is coupled to the thread. By fastening the nut 175, the metallic case upper plate 162 is sandwiched from the inner side and the outer side by means of the metallic rod main body portion 173 and the nut 175, so that the metallic rod 171 can be fixed in a predetermined position. In order to move the metallic rod 171 in the direction intersecting the center axis, of the cylindrical dielectric material 4, the nut 175 is loosened and the metallic rod 171 is slided in the direction of the arrow 172 along the slit 167, and then the nut 175 is fastened when the metallic rod 171 is brought to a predetermined position.

As a result of the above described structure, by sliding the metallic rod 171 in the direction of the arrow 172, the resonance frequency of the resonator 170 can be adjusted.

Since the resonance frequency can be adjusted by simply sliding the metallic rod 171 along the slit 167 in the embodiment, i.e. the metallic rod 171 need not be displaced in the length direction, no outer dimension of the metallic case 161 is changed substantially and hence the geometry of the dielectric resonator as a whole can be always kept constant. Accordingly, no geometry of the dielectric resonator is changed as a whole and the contour of the resonator is kept constant, with the result that an advantage is brought about that the products are highly practicable.

Insertion of the metallic rod 171 into the metallic case 161 can be equally performed by not only forming the above described slit 167 into the metallic case 161 and by inserting the metallic rod 171 into the case 161 through the slit 167 but also by forming a number of apertures on the case upper plate 162 from the center to the end portion and by inserting the metallic rod 171 into any proper one of these apertures. Insertion of the metallic rod 171 may be made not only to the apertures formed on the metallic case upper plate 162 but also to the apertures formed on the metallic case side portion.

The metallic rod 171 for adjusting the resonance frequency employed in the above described embodiments may be formed not only of circular section but also of any other shape such as triangular in section, for example. The adjusting metallic rod may be made of a dielectric material, metallized on the outer surface.

Figure 40:
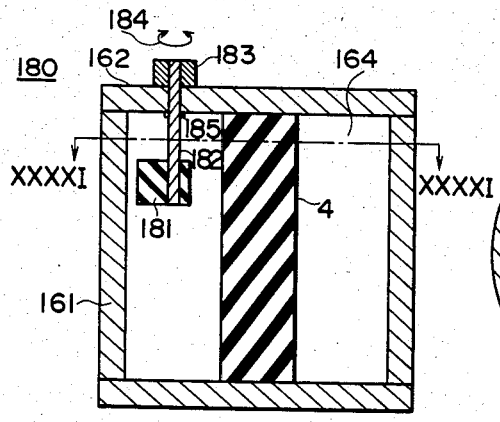
FIG. 40 is a longitudinal sectional view of still a further embodiment of the present invention.
Figure 41:
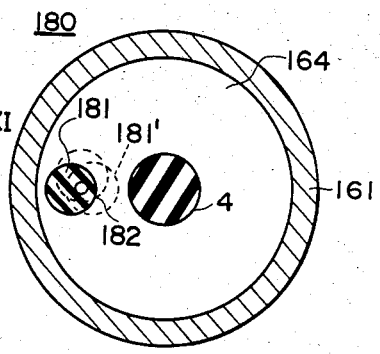
FIG. 41 is a transverse sectional view taken along the line XXXXI—XXXXI of the embodiment shown in FIG. 40.

FIG. 40 is a longitudinal sectional view of still a further embodiment of the present invention, and FIG. 41 is a transverse sectional view taken along the line XXXXI—XXXXI shown in FIG. 40. The embodiment shown is characterized in that the adjusting rod 182 has an adjusting member 181 made of a dielectric material connected eccentrically to the tip end. Adjusting rod 182 is inserted so as to be rotatable and is inserted in a direction parallel with the center axis of the pillar dielectric material 4 from the upper plate 162 of the metallic case 161. Referring to FIG. 40, the knob 183 fixed to the outer periphery at the end portion of the adjusting rod 182 is provided for facility of rotation of the adjusting rod 182 in the direction of the arrow 184. The O ring 185 is fitted to the adjusting rod 182 so that the adjusting rod 182 may not be moved upward and downward.

As a result of the above described structure, the resonance frequency $f_0$ of the resonator 180 can be changed by rotating the knob 183 in the direction of the arrow 184. This is because the electric field exists in the concavity 164 defined by the metallic case 161 and the eccentric connection of the dielectric adjusting member 181 to the adjusting rod 182 in the concavity 164 causes a change in the position of the adjusting member 181 when the adjusting rod 182 is rotated (see FIG. 41). This changes the electric field about the moving adjusting member 181, resulting in a change of the whole effective dielectric constant. More specifically, assume that the intensity of the electric field in the concavity 164 when the dielectric adjusting member 181 is brought farthest from the pillar dielectric material 4, i.e. the same is placed in the state shown by the solid line in FIG. 41, is $E_1$, and the effective dielectric constant at that time is $\epsilon_1$. Also assume that the intensity of the electric field in the concavity 164 when the adjusting member 181 is brought closest to the pillar dielectric material 4, i.e. the same is brought in a state shown by the dotted line 181' in FIG. 41, is $E_2$, and the effective electric constant at that time is $\epsilon_2$. Then the following equation is obtained:

$$-(\Delta\omega_0/\omega_0)=\{(\tfrac{1}{2})\,(\epsilon HD\ 2-\epsilon_1)\cdot E_1E_2{}^*dV\}/W_T$$

where $\omega_0=2\pi f_0$ $\Delta\omega_0$=a variation of $\omega_0$ $W_T$=the total resonating energy

*=a conjugate complex number

Thus, by rotating the adjusting rod 182 through rotation of the knob 183 and by changing the position of the adjusting member 181 provided at the tip end thereof, $(\epsilon_2-\epsilon_1)$ is changed and the resonance frequency $f_0$ can be changed. More specifically, when the adjusting member 181 is brought farther from the pillar dielectric material 4, the frequency $f_0$ is increased, while when the adjusting member 181 is brought closer to the pillar dielectric material 4, the frequency $f_0$ is decreased.

Assuming that the temperature coefficient of the dielectric constant of the adjusting member 181 is different from the temperature coefficient of the dielectric constant of the pillar dielectric material 4, then an advantage is brought about that the temperature characteristic of the resonance frequency $f_0$ can be improved. More specifically, the temperature coefficient of the effective dielectric constant in the concavity exerting an influence upon the temperature characteristic of the resonance frequency can be improved, by properly selecting the temperature coefficient of the adjusting member 181 and by offsetting or reinforcing the coefficient of the pillar dielectric material 4.

Although the embodiment was adapted such that only one adjusting member 181 is inserted, the embodiment may be adapted such that two or more adjusting members are inserted. The embodiment also employed a case made of metal, but alternatively the case may be made of a dielectric material with a conductive film formed on the inner or outer surface thereof. A rotational supporting mechanism and a rotational driving mechanism of the adjusting rod 182 may employ any other well-known structures, as is a matter of course.

Figure 42:
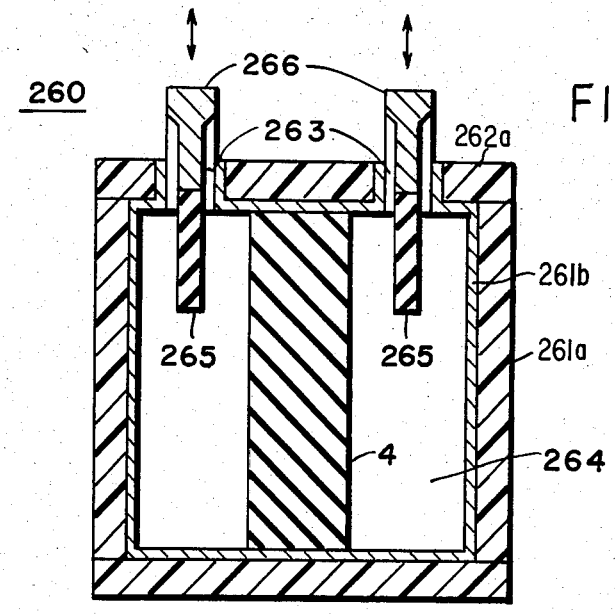
FIG. 42 is a longitudinal sectional view of a further embodiment of the invention, which is similar to the embodiment of FIG. 33 but includes a case structure similar to the embodiment of FIG. 12.
Figure 43:
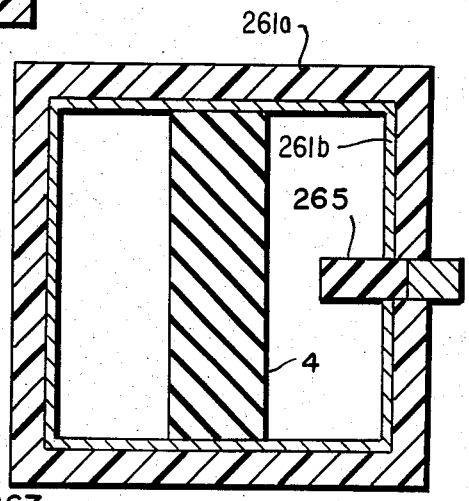
FIG. 43 is a longitudinal sectional view of a further embodiment of the invention, which is similar to FIG. 34, but including a case structure similar to FIG. 12.
Figure 44:
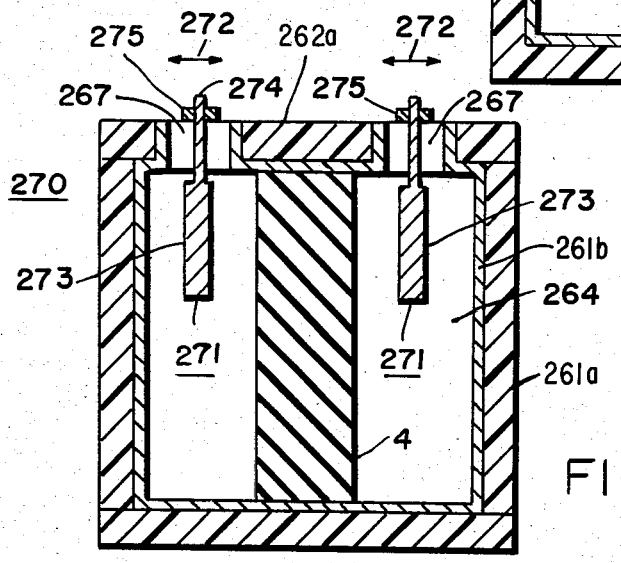
FIG. 44 is a longitudinal sectional view of a further embodiment of the invention similar to the embodiment of FIG. 38, but including a case structure similar to that in FIG. 12.
Figure 45:
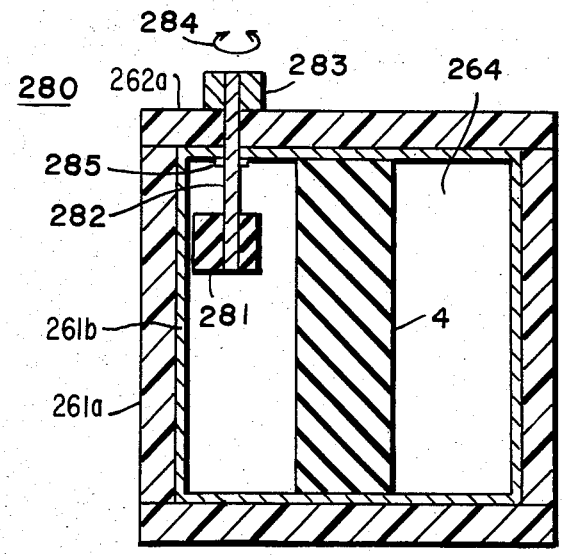
FIG. 45 is a longitudinal sectional view of a further embodiment of the invention similar to that in FIG. 40, but including a case structure similar to that in FIG. 12.
Figure 46:
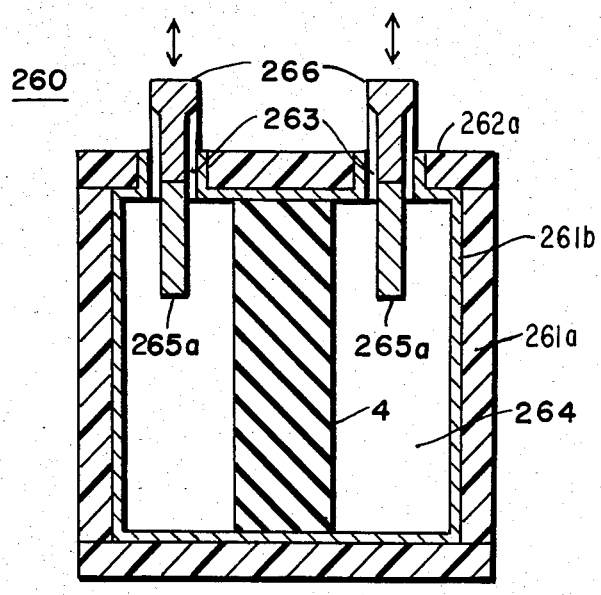
FIG. 46 is a longitudinal section view of a further embodiment of the invention similar to that in FIG. 33, but including a case structure similar to that in FIG. 12, and having metallic frequency adjusting members.

FIGS. 42–46 show additional embodiments of the invention. These embodiments are similar to those in FIGS. 33, 34, 38, and 40. More specifically, FIG. 42 is a longitudinal sectional view of a further embodiment of the invention, which is similar to the embodiment of FIG. 33 but includes a case structure similar to the embodiment of FIG. 12. FIG. 43 is a longitudinal sectional view similar to FIG. 34, but including a case structure similar to FIG. 12. FIG. 44 is a longitudinal sectional view of a further embodiment of the invention similar to the embodiment of FIG. 38, but including a case structure similar to that in FIG. 12. FIG. 45 is a longitudinal sectional view of a further embodiment of the invention similar to that in FIG. 40, but including a case structure similar to that in FIG. 12. FIG. 46 is a longitudinal section view of a further embodiment of the invention similar to that in FIG. 33, but including a case structure similar to that in FIG. 12, and having metallic frequency adjusting members.

Since the features shown in FIGS. 42–46 correspond closely to the features in FIGS. 33, 34, 38, and 40, the reference numerals in FIGS. 33, 34, 38, and 40 have been increased by 100 in FIGS. 42–46 to indicate that the reference numerals in the latter figures correspond to like elements and parts. In these figures, reference numerals **261*a*, 261*b*, and 262*a* together indicate a case structure similar to that in FIG. 12. That is, 261*a* indicates a case comprising dielectric material. 262*a* indicates a cover for the case 261*a*, the cover also comprising dielectric material. 261*b* indicates a conductive film which is formed on the inner surface of the case 261*a* and cover 262*a*, including on the inner surface of apertures therein, including apertures 263 in FIGS. 42 and 46, and apertures 267 in FIG. 44. In addition, in FIG. 46, reference numeral 265*a*** indicates metallic frequency adjusting members.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric resonator adapted to operate in $TM_{010}$ type modes, comprising:

a case having peripheral sides comprised of dielectric material having a given coefficient of linear expansion, said peripheral sides having an inner surface which faces an interior region defined by said case and an outer surface outside said interior region;

a conductive film extending over at least one of said inner surface and said outer surface and forming an enclosure for said interior region, said case having an input/output energy coupling opening therein; and a pillar comprised of dielectric material, said dielectric material of said pillar having a coefficient of linear expansion equal to said given coefficient of linear expansion of said case, said pillar being located in said interior region and having a longitudinal dimension and a longitudinally extending axis which extends along a wave propagation axis associated with said resonator, said pillar having a peripheral side surface which extends around and along said longitudinal axis, and first and second ends longitudinally opposite to one another, at least the major portion of said peripheral side surface of said pillar being in contact with dielectric material within said interior region.

2. A dielectric resonator in accordance with claim 1, wherein at least a portion of said case is integrally formed with said pillar.

3. A dielectric resonator in accordance with claim 2, wherein said portion of said case comprises a coupling portion for coupling the peripheral inner surface thereof to the side surface of said pillar.

4. A dielectric resonator in accordance with claim 1, wherein said conductive film extends continuously across surface boundaries defined by said peripheral sides of said case.

5. A dielectric resonator in accordance with claim 1, wherein the peripheral side surface of said pillar dielectric material is in contact with the inner surface of said case, and said conductive film is formed on said outer surface of said case.

6. A dielectric resonator in accordance with claim 1, wherein said case comprises an opening located adjacent one of said first and second ends of said pillar, and a lid member for covering said opening.

7. A dielectric resonator in accordance with claim 1, wherein said case further comprises a portion formed of a material of good thermal conductivity at a position adjacent at least one of said first and second ends of said pillar.

8. A dielectric resonator in accordance with claim 1, wherein said case further comprises a rubber member of good thermal conductivity covering at least a portion of the outer surface of said case.

9. A dielectric resonator in accordance with claim 1, wherein said pillar dielectric material and said case resonate at an adjustable resonance frequency, the dielectric resonator further comprising a frequency adjusting member for insertion into said case for adjusting the resonance frequency.

10. A dielectric resonator in accordance with claim 9, wherein said frequency adjusting member comprises a member inserted so as to be movable in the direction of said axis of said pillar.

11. A dielectric resonator in accordance with claim 9, wherein said frequency adjusting member comprises an adjusting rod adapted to be externally rotated and extending in parallel to said axis of said pillar and having an adjusting member at an end thereof which is located inside said case.

12. A dielectric resonator in accordance with claim 9, wherein said frequency adjusting member comprises a conductive material.

13. A dielectric resonator in accordance with claim 9, wherein said frequency adjusting member comprises a given dielectric material.

14. A dielectric resonator in accordance with claim 13, wherein said given dielectric material comprised in said frequency adjusting member has a temperature coefficient which is different from that associated with said pillar.

15. A dielectric resonator for electromagnetic waves at a resonant frequency, comprising:

a case comprised of dielectric material having surfaces which define an interior region bounded by said case, a conductive film located on said surfaces of said case in contact with the dielectric material of said case, said conductive film substantially enclosing said region, the dielectric material of said case having a given coefficient of linear expansion; and a first element having a body comprised of dielectric material and located in said region and having said given coefficient of linear expansion, most of an outer surface of said first element, which outer surface is defined by the dielectric material of said first element, being exposed in said interior region of said case whereby both said case and said element have the same said given coefficient of linear expansion for stabilizing said resonant frequency of electromagnetic waves in said region.

16. The dielectric resonator of claim 15 in which electromagnetic waves resonate in said region in $TM_{010}$ type modes.

17. The dielectric resonator of claim 15 in which said first element is fixedly connected to said case.

18. The dielectric resonator of claim 15 in which said case comprises a piece formed of dielectric material, said piece being integral with said first element.

19. The dielectric resonator of claim 18 in which said first element has a side surface and said piece of said dielectric material has an inner surface disposed toward said side surface, said piece of dielectric material comprising a coupling portion for coupling said inner surface to said side surface of said first element.

20. The dielectric resonator of claim 15 in which said first element has an end and said case comprises a body portion defining an opening around said end and a lid for covering said opening defined by said body portion.

21. The dielectric resonator of claim 15 in which said first element has an end abutting a portion of said case, said portion of said case comprising a material of good thermal conductivity for dissipating heat through the case.

22. The dielectric resonator of claim 15 in which said case defines an outer surface, said case further comprising a rubber member of good thermal conductivity covering at least a portion of said outer surface defined by said case.

23. A dielectric resonator adapted to operate in $TM_{010}$ type modes, comprising:

a case having peripheral sides comprised of dielectric material having a given coefficient of linear expansion, said peripheral sides having an inner surface which faces an interior region defined by said case and an outer surface outside said interior region;

a conductive film extending over at least one of said inner surface and said outer surface and forming a metallic case which encloses said interior region; and a pillar comprised of dielectric material having a coefficient of linear expansion equal to said given coefficient of linear expansion, said pillar being located in said interior region and having a longitudinal dimension and a longitudinally extending axis which extends along a wave propagation axis associated with said resonator, said pillar having a peripheral side surface which extends around and along said longitudinal axis and first and second ends longitudinally opposite to one another, said case further comprising an opening located adjacent one of said first and second ends of said pillar and a lid member for covering said opening, said pillar further comprising an electrode film formed on a portion of one of said first and second ends of said pillar which is in contact with said lid member.

24. A dielectric resonator as in claim 23, wherein said conductive film extends over said lid member and is in contact with said electrode film.

25. A dielectric resonator as in claim 23, wherein said electrode film extends substantially in a common plane with said conductive film which is positioned adjacent thereto on said lid member.

26. A dielectric resonator adapted to operate in $TM_{010}$ type modes, comprising:

a case having peripheral sides comprised of dielectric material having a given coefficient of linear expansion, said peripheral sides having an inner surface which faces an interior region defined by said case and an outer surface outside said interior region;

a conductive film extending over at least one of said inner surface and said outer surface and forming a metallic case which encloses said interior region; and a pillar comprised of dielectric material having a coefficient of linear expansion equal to said given coefficient of linear expansion, said pillar being located in said interior region and having a longitudinal dimension and a longitudinally extending axis which extends along a wave propagation axis associated with said resonator, said pillar having a peripheral side surface which extends around and along said longitudinal axis and first and second ends longitudinally opposite to one another, said pillar and said case being adapted to resonate at an adjustable resonance frequency, said dielectric resonator further comprising a frequency adjusting member for insertion into said case for adjusting the resonance frequency, said frequency adjusting members comprising a member which is inserted so as to be movable in a direction which is generally perpendicular to the direction of said longitudinal axis of said pillar.

27. A dielectric resonator adapted to operate in $TM_{010}$ type modes, comprising:

a case having peripheral sides comprised of dielectric material having a given coefficient of linear expansion, said peripheral sides having an inner surface which faces an interior region defined by said case and an outer surface outside said interior region;

a conductive film extending over at least one of said inner surface and said outer surface and forming a metallic case which encloses said interior region; and a pillar comprised of dielectric material having a coefficient of linear expansion equal to said given coefficient of linear expansion, said pillar being located in said interior region and having a longitudinal dimension and a longitudinally extending axis which extends along a wave propagation axis associated with said resonator, said pillar having a peripheral side surface which extends around and along said longitudinal axis and first and second ends longitudinally opposite to one another, said pillar and said case being adapted to resonate at an adjustable resonance frequency, the dielectric resonator further comprising a frequency adjusting member for insertion into said case for adjusting the resonance frequency, said frequency adjusting member comprising a member which extends in parallel to said longitudinal axis of said pillar and which is movable in a direction which is perpendicular to said longitudinal axis of said pillar.

28. A dielectric resonator for electromagnetic waves at a resonant frequency, comprising:

a case comprised of dielectric material having surfaces which define an interior region bounded by said case, a conductive film located on and extending over said dielectric material, said conductive film substantially enclosing said region, said dielectric material of said case having a given coefficient of linear expansion; and a first element having a body comprised of dielectric material and located in said region, said dielectric material of said first element having said above-mentioned given coefficient of linear expansion, said first element being fixedly connected to said case, and said case defining a first planar inner end surface and a second planar inner end surface generally parallel to and spaced from said first planar inner end surface, said first element having first and second ends fixedly connected to said first and second planar inner end surfaces, respectively, both said case and said element having the same said given coefficient of linear expansion for stabilizing said resonant frequency of electromagnetic waves in said region.

29. The dielectric resonator of claim 28 in which said first element is of a cylindrical shape cross-section parallel to the end surfaces.

30. The dielectric resonator of claim 29 in which said case further defines an inner side surface joining said first and second planar inner end surfaces, said inner side surface being generally parallel to said axis of said first element.

31. The dielectric resonator of claim 30 in which said inner side surface abuts the cylindrical side surface of said cylindrical first element.

32. The dielectric resonator of claim 31 in which said dielectric material of said case further defines an outer surface, said conductive film being formed on said outer surface of said dielectric material.

33. The dielectric resonator of claim 30 in which said inner side surface has a rectangular cross-section in each plane generally perpendicular to an axis of said first element which is perpendicular to said cross-section.

34. A dielectric resonator for electromagnetic waves at a resonant frequency, comprising:

a case comprised of dielectric material having surfaces which define an interior region bounded by said case, a conductive film located on and extending over said dielectric material, said conductive film substantially enclosing said region, said dielectric material having a given coefficient of linear expansion; and a first element having a body comprised of dielectric material and located in said region and having said given coefficient of linear expansion, said case comprising a plurality of pieces each of which is comprised of said dielectric material of said case, each piece having an inner surface disposed toward said first element and an outer surface disposed away from said first element, the pieces being joined to form said case whereby both said case and said element have the same said given coefficient of linear expansion for stabilizing said resonant frequency of electromagnetic waves in said region.

35. The dielectric resonator of claim 34 in which said conductive film is formed continuously on the inner surfaces of all of said pieces of said dielectric material.

36. The dielectric resonator of claim 34 in which said conductive film is formed continuously on the outer surfaces of all of said pieces of dielectric material.

37. The dielectric resonator of claim 34 in which said conductive film is formed continuously on the inner surface of at least one of said pieces of dielectric material and on the outer surface of at least another one of said pieces of dielectric material.

38. A dielectric resonator for electromagnetic waves at a resonant frequency, comprising:

a case comprised of dielectric material having surfaces which define an interior region bounded by said case, a conductive film located on and extending over said dielectric material, said conductive film substantially enclosing said region, said dielectric material of said case having a given coefficient of linear expansion; and a first element having a body comprised of dielectric material and located in said region, said dielectric material of said first element having said above-mentioned given coefficient of linear expansion, said case comprising a piece formed of said dielectric material, said piece being integral with said first element, said dielectric resonator further comprising second and third elements located in said region, each comprising dielectric material and being integrally formed with said piece of said case, the respective dielectric materials of said second and third elements each having said above-mentioned given coefficient of linear expansion, both said case and said elements having the same said given coefficient of linear expansion for stabilizing said resonant frequency of electromagnetic waves in said region.

39. A dielectric resonator for electromagnetic waves at a resonant frequency, comprising:

a case comprised of dielectric material having a surface which defines an interior region bounded by said case and an outer surface, a conductive film located on one of said surfaces of said case and extending over and being in contact with the dielectric material of said case, said conductive film substantially enclosing said region, said dielectric material having a given coefficient of linear expansion; and a first element having a body comprised of dielectric material and located in said region and having said given coefficient of linear expansion, said first element having an end and said case comprising a body portion defining an opening around said end and a lid for covering said opening defined by said body portion, said first element comprising an electrode film formed on said end of said first element for contacting said lid.

* * * * *